US010221687B2

(12) United States Patent
Mladjan

(10) Patent No.: US 10,221,687 B2
(45) Date of Patent: Mar. 5, 2019

(54) METHOD OF MINING USING A LASER

(71) Applicant: Gary J. Mladjan, Post Falls, ID (US)

(72) Inventor: Gary J. Mladjan, Post Falls, ID (US)

(73) Assignee: Merger Mines Corporation, Coeur D'Alene, ID (US)

( * ) Notice: Subject to any disclaimer, the term of this patent is extended or adjusted under 35 U.S.C. 154(b) by 630 days.

(21) Appl. No.: 14/952,979

(22) Filed: Nov. 26, 2015

(65) Prior Publication Data

US 2017/0152744 A1 Jun. 1, 2017

(51) Int. Cl.

| | |
|---|---|
| ***E21C 37/18*** | (2006.01) |
| ***E21B 7/15*** | (2006.01) |
| ***E21C 41/00*** | (2006.01) |

(52) U.S. Cl.

CPC ..... *E21C 37/18* (2013.01); *E21B 7/15* (2013.01); *E21C 41/00* (2013.01); *E21C 41/14* (2013.01)

(58) Field of Classification Search

CPC ..... E21C 37/18; E21B 7/15

See application file for complete search history.

(56) References Cited

U.S. PATENT DOCUMENTS

| | | | |
|---|---|---|---|
| 914,636 | A | 3/1909 | Case |
| 2,548,463 | A | 4/1951 | Blood |
| 2,742,555 | A | 4/1956 | Murray |
| 3,122,212 | A | 2/1964 | Karlovitz |
| 3,383,491 | A | 5/1968 | Muncheryan |
| 3,461,964 | A | 8/1969 | Venghiattis |
| 3,493,060 | A | 2/1970 | Van Dyk |
| 3,503,804 | A | 3/1970 | Schneider et al. |
| 3,539,221 | A | 11/1970 | Gladstone |
| 3,544,165 | A | 12/1970 | Snedden |
| 3,556,600 | A | 1/1971 | Shoupp et al. |
| 3,574,357 | A | 4/1971 | Alexandru et al. |
| 3,586,413 | A | 6/1971 | Adams |
| 3,652,447 | A | 3/1972 | Yant |
| 3,693,718 | A | 9/1972 | Stout |
| 3,699,649 | A | 10/1972 | McWilliams |
| 3,802,203 | A | 4/1974 | Ichise et al. |
| 3,820,605 | A | 6/1974 | Barber et al. |

(Continued)

OTHER PUBLICATIONS

PCT Notification of Transmittal of the International Search Report and the Written Dpinion of the International Searching Authority, or the Declaration, dated Jan. 30, 2017; 19pages.

(Continued)

*Primary Examiner* — Sunil Singh

(74) *Attorney, Agent, or Firm* — Randall Danskin PS

(57) ABSTRACT

A method for mining using a laser to cause spalling includes the steps of generating and delivering a laser beam to a work surface of a geological strata having a sought after mineral to be removed from the stratum; moving the laser beam about three perpendicular axes so that a focal point of the laser beam moves across the working surface and rapidly increases the surface temperature of the working surface; providing a source of a cooling media, and delivering the cooling media to the working surface so as to rapidly cool the working surface subsequent to the rapid surface temperature increase generated by the laser beam so as to effect a fracturing of the working surface and to generate a plurality of chips from the working surface; and removing the chips spalled from the working surface.

24 Claims, 9 Drawing Sheets

(56) References Cited

U.S. PATENT DOCUMENTS 3,821,510 A 6/1974 Muncheryan
3,823,788 A 7/1974 Garrison et al.
3,871,485 A 3/1975 Keenan, Jr.
3,882,945 A 5/1975 Keenan, Jr.
3,938,599 A 2/1976 Horn
3,960,448 A 6/1976 Schmidt et al.
3,977,478 A 8/1976 Shuck
3,992,095 A 11/1976 Jacoby et al.
3,998,281 A 12/1976 Salisbury et al.
4,019,331 A 4/1977 Rom et al.
4,025,091 A 5/1977 Zeile, Jr.
4,026,356 A 5/1977 Shuck
4,047,580 A 9/1977 Yahiro et al.
4,057,118 A 11/1977 Ford
4,061,190 A 12/1977 Bloomfield
4,066,138 A 1/1978 Salisbury et al.
4,090,572 A 5/1978 Welch
4,113,036 A 9/1978 Stout
4,125,757 A 11/1978 Ross
4,151,393 A 4/1979 Fenneman et al.
4,162,400 A 7/1979 Pitts, Jr.
4,189,705 A 2/1980 Pitts, Jr.
4,194,536 A 3/1980 Stine et al.
4,199,034 A * 4/1980 Salisbury ..... E21B 7/15 166/308.1
4,227,582 A 10/1980 Price
4,228,856 A 10/1980 Reale
4,243,298 A 1/1981 Kao et al.
4,249,925 A 2/1981 Kawashima et al.
4,252,015 A 2/1981 Harbon et al.
4,256,146 A 3/1981 Genini et al.
4,266,609 A 5/1981 Rom et al.
4,280,535 A 7/1981 Willis
4,281,891 A 8/1981 Shinohara et al.
4,282,940 A 8/1981 Salisbury et al.
4,332,401 A 6/1982 Stephenson et al.
4,336,415 A 6/1982 Walling
4,340,245 A 7/1982 Stalder
4,367,917 A 1/1983 Gray
4,370,886 A 2/1983 Smith, Jr. et al.
4,374,530 A 2/1983 Walling
4,375,164 A 3/1983 Dodge et al.
4,389,645 A 6/1983 Wharton
4,415,184 A 11/1983 Stephenson et al.
4,417,603 A 11/1983 Argy
4,436,177 A 3/1984 Elliston
4,444,420 A 4/1984 McStravick et al.
4,453,570 A 6/1984 Hutchison
4,459,731 A 7/1984 Hutchison
4,477,106 A 10/1984 Hutchison
4,504,112 A 3/1985 Gould et al.
4,522,464 A 6/1985 Thompson et al.
4,531,552 A 7/1985 Kim
4,565,351 A 1/1986 Conti et al.
4,662,437 A 5/1987 Renfro
4,694,865 A 9/1987 Tauschmann
4,725,116 A 2/1988 Spencer et al.
4,741,405 A 5/1988 Moeny et al.
4,744,420 A 5/1988 Patterson et al.
4,770,493 A 9/1988 Ara et al.
4,793,383 A 12/1988 Gyory et al.
4,830,113 A 5/1989 Geyer
4,860,654 A 8/1989 Chawla et al.
4,860,655 A 8/1989 Chawla
4,872,520 A 10/1989 Nelson
4,924,870 A 5/1990 Wlodarczyk et al.
4,952,771 A 8/1990 Wrobel
4,989,236 A 1/1991 Myllymaki
4,997,250 A 3/1991 Ortiz, Jr.
5,003,144 A 3/1991 Lindroth et al.
5,004,166 A 4/1991 Sellar
5,033,545 A 7/1991 Sudol
5,049,738 A 9/1991 Gergely et al.
5,084,617 A 1/1992 Gergely
5,086,842 A 2/1992 Cholet
5,107,936 A 4/1992 Foppe
5,121,872 A 6/1992 Legget
5,125,061 A 6/1992 Marlier et al.
5,125,063 A 6/1992 Panuska et al.
5,128,882 A 7/1992 Cooper et al.
5,140,664 A 8/1992 Bosisio et al.
5,163,321 A 11/1992 Perales
5,168,940 A 12/1992 Foppe
5,172,112 A 12/1992 Jennings
5,212,755 A 5/1993 Holmberg
5,269,377 A 12/1993 Martin
5,285,204 A 2/1994 Sas-Jaworsky
5,348,097 A 9/1994 Giannesini et al.
5,351,533 A 10/1994 Macadam et al.
5,353,875 A 10/1994 Schultz et al.
5,355,967 A 10/1994 Mueller et al.
5,356,081 A 10/1994 Sellar
5,396,805 A 3/1995 Surjaatmadja
5,411,081 A 5/1995 Moore et al.
5,411,085 A 5/1995 Moore et al.
5,411,105 A 5/1995 Gray
5,413,045 A 5/1995 Miszewski
5,413,170 A 5/1995 Moore
5,419,188 A 5/1995 Rademaker et al.
5,423,383 A 6/1995 Pringle
5,425,420 A 6/1995 Pringle
5,435,351 A 7/1995 Head
5,435,395 A 7/1995 Connell
5,463,711 A 10/1995 Chu
5,465,793 A 11/1995 Pringle
5,469,878 A 11/1995 Pringle
5,479,860 A 1/1996 Ellis
5,483,988 A 1/1996 Pringle
5,488,992 A 2/1996 Pringle
5,500,768 A 3/1996 Doggett et al.
5,503,014 A 4/1996 Griffith
5,503,370 A 4/1996 Newman et al.
5,505,259 A 4/1996 Wittrisch et al.
5,515,926 A 5/1996 Boychuk
5,526,887 A 6/1996 Vestavik
5,561,516 A 10/1996 Noble et al.
5,566,764 A 10/1996 Elliston
5,573,225 A 11/1996 Boyle et al.
5,577,560 A 11/1996 Coronado et al.
5,586,609 A 12/1996 Schuh
5,599,004 A 2/1997 Newman et al.
5,615,052 A 3/1997 Doggett
5,638,904 A 6/1997 Misselbrook et al.
5,655,745 A 8/1997 Morrill
5,694,408 A 12/1997 Bott et al.
5,707,939 A 1/1998 Patel
5,757,484 A 5/1998 Miles et al.
5,759,859 A 6/1998 Sausa
5,771,984 A 6/1998 Potter et al.
5,773,791 A 6/1998 Kuykendal
5,794,703 A 8/1998 Newman et al.
5,813,465 A 9/1998 Terrell et al.
5,828,003 A 10/1998 Thomeer et al.
5,832,006 A 11/1998 Rice et al.
5,833,003 A 11/1998 Longbottom et al.
5,847,825 A 12/1998 Alexander
5,862,273 A 1/1999 Pelletier
5,862,862 A 1/1999 Terrell
5,896,482 A 4/1999 Blee et al.
5,896,938 A 4/1999 Moeny et al.
5,902,499 A 5/1999 Richerzhagen
5,909,306 A 6/1999 Goldberg et al.
5,913,337 A 6/1999 Williams et al.
5,924,489 A 7/1999 Hatcher
5,929,986 A 7/1999 Slater et al.
5,933,945 A 8/1999 Thomeer et al.
5,938,954 A 8/1999 Onuma et al.
5,973,783 A 10/1999 Goldner et al.
5,986,756 A 11/1999 Slater et al.
RE36,525 E 1/2000 Pringle
6,015,015 A 1/2000 Luft et al.
6,038,363 A 3/2000 Slater et al.
6,059,037 A 5/2000 Longbottom et al.
6,060,662 A 5/2000 Rafie et al.

(56) References Cited

U.S. PATENT DOCUMENTS

| | | | |
|---|---|---|---|
| 6,065,540 | A | 5/2000 | Thomeer et al. |
| RE36,723 | E | 6/2000 | Moore et al. |
| 6,076,602 | A | 6/2000 | Gano et al. |
| 6,092,601 | A | 7/2000 | Gano et al. |
| 6,104,022 | A | 8/2000 | Young et al. |
| RE36,880 | E | 9/2000 | Pringle |
| 6,116,344 | A | 9/2000 | Longbottom et al. |
| 6,135,206 | A | 10/2000 | Gano et al. |
| 6,147,754 | A | 11/2000 | Theriault et al. |
| 6,157,893 | A | 12/2000 | Berger et al. |
| 6,166,546 | A | 12/2000 | Scheihing et al. |
| 6,215,734 | B1 | 4/2001 | Moeny et al. |
| 6,227,300 | B1 | 5/2001 | Cunningham et al. |
| 6,250,391 | B1 | 6/2001 | Proudfoot |
| 6,273,193 | B1 | 8/2001 | Hermann et al. |
| 6,275,645 | B1 | 8/2001 | Vereecken et al. |
| 6,281,489 | B1 | 8/2001 | Tubel et al. |
| 6,301,423 | B1 | 10/2001 | Olson |
| 6,309,195 | B1 | 10/2001 | Bottos et al. |
| 6,321,839 | B1 | 11/2001 | Vereecken et al. |
| 6,352,114 | B1 | 3/2002 | Toalson et al. |
| 6,355,928 | B1 | 3/2002 | Skinner et al. |
| 6,356,683 | B1 | 3/2002 | Hu et al. |
| 6,377,591 | B1 | 4/2002 | Hollister et al. |
| 6,384,738 | B1 | 5/2002 | Carstensen et al. |
| 6,386,300 | B1 | 5/2002 | Curlett et al. |
| 6,401,825 | B1 | 6/2002 | Woodrow |
| 6,426,479 | B1 | 7/2002 | Bischof |
| 6,437,326 | B1 | 8/2002 | Yamate et al. |
| 6,450,257 | B1 | 9/2002 | Douglas |
| 6,494,259 | B2 | 12/2002 | Surjaatmadja |
| 6,497,290 | B1 | 12/2002 | Misselbrook et al. |
| 6,557,249 | B1 | 5/2003 | Pruett et al. |
| 6,561,289 | B2 | 5/2003 | Portman et al. |
| 6,564,046 | B1 | 5/2003 | Chateau |
| 6,591,046 | B2 | 7/2003 | Stottlemyer |
| 6,615,922 | B2 | 9/2003 | Deul et al. |
| 6,626,249 | B2 | 9/2003 | Rosa |
| 6,644,848 | B1 | 11/2003 | Clayton et al. |
| 6,661,815 | B1 | 12/2003 | Kozlovsky et al. |
| 6,710,720 | B2 | 3/2004 | Carstensen et al. |
| 6,712,150 | B1 | 3/2004 | Misselbrook et al. |
| 6,725,924 | B2 | 4/2004 | Davidson et al. |
| 6,747,743 | B2 | 6/2004 | Skinner et al. |
| 6,755,262 | B2 | 6/2004 | Parker |
| 6,808,023 | B2 | 10/2004 | Smith et al. |
| 6,832,654 | B2 | 12/2004 | Ravensbergen et al. |
| 6,847,034 | B2 | 1/2005 | Shah et al. |
| 6,851,488 | B2 | 2/2005 | Batarseh |
| 6,867,858 | B2 | 3/2005 | Owen et al. |
| 6,870,128 | B2 | 3/2005 | Kobayashi et al. |
| 6,874,361 | B1 | 4/2005 | Meltz et al. |
| 6,880,646 | B2 | 4/2005 | Batarseh |
| 6,885,784 | B2 | 4/2005 | Bohnert |
| 6,888,097 | B2 | 5/2005 | Batarseh |
| 6,888,127 | B2 | 5/2005 | Jones et al. |
| 6,912,898 | B2 | 7/2005 | Jones et al. |
| 6,913,079 | B2 | 7/2005 | Tubel |
| 6,920,395 | B2 | 7/2005 | Brown |
| 6,920,946 | B2 | 7/2005 | Oglesby |
| 6,923,273 | B2 | 8/2005 | Terry et al. |
| 6,957,576 | B2 | 10/2005 | Skinner et al. |
| 6,967,322 | B2 | 11/2005 | Jones et al. |
| 6,977,367 | B2 | 12/2005 | Tubel et al. |
| 6,978,832 | B2 | 12/2005 | Gardner et al. |
| 6,981,561 | B2 | 1/2006 | Krueger et al. |
| 6,994,162 | B2 | 2/2006 | Robison |
| 7,040,746 | B2 | 5/2006 | McCain et al. |
| 7,055,604 | B2 | 6/2006 | Jee et al. |
| 7,055,629 | B2 | 6/2006 | Oglesby |
| 7,072,044 | B2 | 7/2006 | Kringlebotn et al. |
| 7,072,588 | B2 | 7/2006 | Skinner |
| 7,086,484 | B2 | 8/2006 | Smith, Jr. |
| 7,087,865 | B2 | 8/2006 | Lerner |
| 7,088,437 | B2 | 8/2006 | Blomster et al. |
| 7,126,332 | B2 | 10/2006 | Blanz et al. |
| 7,134,488 | B2 | 11/2006 | Tudor et al. |
| 7,134,514 | B2 | 11/2006 | Riel et al. |
| 7,140,435 | B2 | 11/2006 | Defretin et al. |
| 7,147,064 | B2 | 12/2006 | Batarseh et al. |
| 7,152,700 | B2 | 12/2006 | Church et al. |
| 7,163,875 | B2 | 1/2007 | Richerzhagen |
| 7,172,026 | B2 | 2/2007 | Misselbrook |
| 7,172,038 | B2 | 2/2007 | Terry et al. |
| 7,174,067 | B2 | 2/2007 | Murshid et al. |
| 7,188,687 | B2 | 3/2007 | Rudd et al. |
| 7,195,731 | B2 | 3/2007 | Jones |
| 7,196,786 | B2 | 3/2007 | DiFoggio |
| 7,199,869 | B2 | 4/2007 | MacDougall |
| 7,201,222 | B2 | 4/2007 | Kanady et al. |
| 7,210,343 | B2 | 5/2007 | Shammai et al. |
| 7,212,283 | B2 | 5/2007 | Hother et al. |
| 7,249,633 | B2 | 7/2007 | Ravensbergen et al. |
| 7,264,057 | B2 | 9/2007 | Rytlewski et al. |
| 7,270,195 | B2 | 9/2007 | MacGregor et al. |
| 7,273,108 | B2 | 9/2007 | Misselbrook |
| 7,334,637 | B2 | 2/2008 | Smith, Jr. |
| 7,337,660 | B2 | 3/2008 | Ibrahim et al. |
| 7,362,422 | B2 | 4/2008 | DiFoggio et al. |
| 7,372,230 | B2 | 5/2008 | McKay |
| 7,394,064 | B2 | 7/2008 | Marsh |
| 7,395,696 | B2 | 7/2008 | Bissonnette et al. |
| 7,416,032 | B2 | 8/2008 | Moeny et al. |
| 7,416,258 | B2 | 8/2008 | Reed et al. |
| 7,424,190 | B2 | 9/2008 | Dowd et al. |
| 7,471,831 | B2 | 12/2008 | Bearman et al. |
| 7,487,834 | B2 | 2/2009 | Reed et al. |
| 7,490,664 | B2 | 2/2009 | Skinner et al. |
| 7,503,404 | B2 | 3/2009 | McDaniel et al. |
| 7,515,782 | B2 | 4/2009 | Zhang et al. |
| 7,516,802 | B2 | 4/2009 | Smith, Jr. |
| 7,518,722 | B2 | 4/2009 | Julian et al. |
| 7,527,108 | B2 | 5/2009 | Moeny |
| 7,530,406 | B2 | 5/2009 | Moeny et al. |
| 7,559,378 | B2 | 7/2009 | Moeny |
| 7,587,111 | B2 | 9/2009 | de Montmorillon et al. |
| 7,600,564 | B2 | 10/2009 | Shampine et al. |
| 7,603,011 | B2 | 10/2009 | Varkey et al. |
| 7,617,873 | B2 | 11/2009 | Lovell et al. |
| 7,624,743 | B2 | 12/2009 | Sarkar et al. |
| 7,628,227 | B2 | 12/2009 | Marsh |
| 7,646,953 | B2 | 1/2010 | Dowd et al. |
| 7,647,948 | B2 | 1/2010 | Quigley et al. |
| 7,671,983 | B2 | 3/2010 | Shammai et al. |
| 7,715,664 | B1 | 5/2010 | Shou et al. |
| 7,720,323 | B2 | 5/2010 | Yamate et al. |
| 7,769,260 | B2 | 8/2010 | Hansen et al. |
| 7,802,384 | B2 | 9/2010 | Kobayashi et al. |
| 7,834,777 | B2 | 11/2010 | Gold |
| 7,848,368 | B2 | 12/2010 | Gapontsev et al. |
| 7,900,699 | B2 | 3/2011 | Ramos et al. |
| 7,938,175 | B2 | 5/2011 | Skinner et al. |
| 8,011,454 | B2 | 9/2011 | Castillo |
| 8,074,332 | B2 | 12/2011 | Keatch et al. |
| 8,082,996 | B2 | 12/2011 | Kocis et al. |
| 8,091,638 | B2 | 1/2012 | Dusterhoft et al. |
| 8,109,345 | B2 | 2/2012 | Jeffryes |
| 8,175,433 | B2 | 5/2012 | Caldwell et al. |
| 2002/0007945 | A1 | 1/2002 | Neuroth et al. |
| 2002/0039465 | A1 | 4/2002 | Skinner |
| 2002/0189806 | A1 | 12/2002 | Davidson et al. |
| 2003/0000741 | A1 | 1/2003 | Rosa |
| 2003/0053783 | A1 | 3/2003 | Shirasaki |
| 2003/0056990 | A1 | 3/2003 | Oglesby |
| 2003/0085040 | A1 | 5/2003 | Hemphill et al. |
| 2003/0094281 | A1 | 5/2003 | Tubel |
| 2003/0132029 | A1 | 7/2003 | Parker |
| 2003/0145991 | A1 | 8/2003 | Olsen |
| 2003/0159283 | A1 | 8/2003 | White |
| 2003/0160164 | A1 | 8/2003 | Jones et al. |
| 2003/0226826 | A1 | 12/2003 | Kobayashi et al. |
| 2004/0006429 | A1 | 1/2004 | Brown |
| 2004/0016295 | A1 | 1/2004 | Skinner et al. |
| 2004/0020643 | A1 | 2/2004 | Thomeer et al. |

(56) References Cited

U.S. PATENT DOCUMENTS

2004/0026382 A1 2/2004 Richerzhagen
2004/0033017 A1 2/2004 Kringlebotn et al.
2004/0074979 A1 4/2004 McGuire
2004/0093950 A1 5/2004 Bohnert
2004/0112642 A1 6/2004 Krueger et al.
2004/0119471 A1 6/2004 Blanz et al.
2004/0129418 A1 7/2004 Jee et al.
2004/0195003 A1 10/2004 Batarseh
2004/0206505 A1 10/2004 Batarseh
2004/0207731 A1 10/2004 Bearman et al.
2004/0211894 A1 10/2004 Hother et al.
2004/0218176 A1 11/2004 Shammal et al.
2004/0244970 A1 12/2004 Smith, Jr.
2004/0252748 A1 12/2004 Gleitman
2004/0256103 A1 12/2004 Batarseh
2005/0007583 A1 1/2005 DiFoggio
2005/0012244 A1 1/2005 Jones
2005/0034857 A1 2/2005 Defretin et al.
2005/0094129 A1 5/2005 MacDougall
2005/0099618 A1 5/2005 DiFoggio et al.
2005/0115741 A1 6/2005 Terry et al.
2005/0121235 A1 6/2005 Larsen et al.
2005/0189146 A1 9/2005 Oglesby
2005/0201652 A1 9/2005 Ellwood, Jr.
2005/0230107 A1 10/2005 McDaniel et al.
2005/0252286 A1 11/2005 Ibrahim et al.
2005/0263281 A1 12/2005 Lovell et al.
2005/0268704 A1 12/2005 Bissonnette et al.
2005/0269132 A1 12/2005 Batarseh et al.
2005/0272512 A1 12/2005 Bissonnette et al.
2005/0272513 A1 12/2005 Bissonnette et al.
2005/0272514 A1 12/2005 Bissonnette et al.
2005/0282645 A1 12/2005 Bissonnette et al.
2006/0038997 A1 2/2006 Julian et al.
2006/0049345 A1 3/2006 Rao et al.
2006/0065815 A1 3/2006 Jurca
2006/0070770 A1 4/2006 Marsh
2006/0102343 A1 5/2006 Skinner et al.
2006/0118303 A1 6/2006 Schultz et al.
2006/0137875 A1 6/2006 Dusterhoft et al.
2006/0185843 A1 8/2006 Smith, Jr.
2006/0191684 A1 8/2006 Smith, Jr.
2006/0204188 A1 9/2006 Clarkson et al.
2006/0207799 A1 9/2006 Yu
2006/0231257 A1 10/2006 Reed et al.
2006/0237233 A1 10/2006 Reed et al.
2006/0260832 A1 11/2006 McKay
2006/0266522 A1 11/2006 Eoff et al.
2006/0283592 A1 12/2006 Sierra et al.
2006/0289724 A1 12/2006 Skinner et al.
2007/0034409 A1 2/2007 Dale et al.
2007/0081157 A1 4/2007 Csutak et al.
2007/0125163 A1 6/2007 Dria et al.
2007/0193990 A1 8/2007 Richerzhagen et al.
2007/0217736 A1 9/2007 Zhang et al.
2007/0227741 A1 10/2007 Lovell et al.
2007/0242265 A1 10/2007 Vessereau et al.
2007/0247701 A1 10/2007 Akasaka et al.
2007/0267220 A1 11/2007 Magiawala et al.
2007/0278195 A1 12/2007 Richerzhagen et al.
2007/0280615 A1 12/2007 de Montmorillon et al.
2008/0023202 A1 1/2008 Keatch et al.
2008/0053702 A1 3/2008 Smith, Jr.
2008/0073077 A1 3/2008 Tunc et al.
2008/0093125 A1 4/2008 Potter et al.
2008/0112760 A1 5/2008 Curlett
2008/0128123 A1 6/2008 Gold
2008/0138022 A1 6/2008 Tassone
2008/0165356 A1 7/2008 DiFoggio et al.
2008/0166132 A1 7/2008 Lynde et al.
2008/0180787 A1 7/2008 DiGiovanni et al.
2008/0245568 A1 10/2008 Jeffryes
2008/0273852 A1 11/2008 Parker et al.
2009/0020333 A1 1/2009 Marsh
2009/0031870 A1 2/2009 O'Connor
2009/0033176 A1 2/2009 Huang et al.
2009/0049345 A1 2/2009 Mock et al.
2009/0050371 A1 2/2009 Moeny
2009/0078467 A1 3/2009 Castillo
2009/0105955 A1 4/2009 Castillo et al.
2009/0126235 A1 5/2009 Kobayashi et al.
2009/0133871 A1 5/2009 Skinner et al.
2009/0133929 A1 5/2009 Rodland
2009/0139768 A1 6/2009 Castillo
2009/0166042 A1 7/2009 Skinner
2009/0190887 A1 7/2009 Freeland et al.
2009/0194292 A1 8/2009 Oglesby
2009/0205675 A1 8/2009 Sarkar et al.
2009/0260834 A1 10/2009 Henson et al.
2009/0266552 A1 10/2009 Barra et al.
2009/0266562 A1 10/2009 Greenaway
2009/0272424 A1 11/2009 Ortabasi
2009/0272547 A1 11/2009 Dale et al.
2009/0279835 A1 11/2009 de Montmorillon et al.
2009/0294050 A1 12/2009 Traggis et al.
2009/0308852 A1 12/2009 Alpay et al.
2009/0324183 A1 12/2009 Bringuier et al.
2010/0000790 A1 1/2010 Moeny
2010/0001179 A1 1/2010 Kobayashi et al.
2010/0008631 A1 1/2010 Herbst
2010/0013663 A1 1/2010 Cavender et al.
2010/0018703 A1 1/2010 Lovell et al.
2010/0025032 A1 2/2010 Smith et al.
2010/0032207 A1 2/2010 Potter et al.
2010/0044102 A1* 2/2010 Rinzler ..... E21B 7/14 175/15
2010/0044103 A1 2/2010 Moxley et al.
2010/0044104 A1 2/2010 Zediker et al.
2010/0044105 A1 2/2010 Faircloth et al.
2010/0044106 A1 2/2010 Zediker et al.
2010/0071794 A1 3/2010 Homan
2010/0078414 A1 4/2010 Perry et al.
2010/0084132 A1 4/2010 Noya et al.
2010/0089571 A1 4/2010 Revellat et al.
2010/0089574 A1 4/2010 Wideman et al.
2010/0089576 A1 4/2010 Wideman et al.
2010/0089577 A1 4/2010 Wideman et al.
2010/0155059 A1 6/2010 Ullah
2010/0170672 A1 7/2010 Schwoebel et al.
2010/0170680 A1 7/2010 McGregor et al.
2010/0187010 A1 7/2010 Abbasi et al.
2010/0197116 A1 8/2010 Shah et al.
2010/0218993 A1 9/2010 Wideman et al.
2010/0224408 A1 9/2010 Kocis et al.
2010/0226135 A1 9/2010 Chen
2010/0236785 A1 9/2010 Collis et al.
2010/0326659 A1 12/2010 Schultz et al.
2010/0326665 A1 12/2010 Redlinger et al.
2011/0030957 A1 2/2011 Constantz et al.
2011/0035154 A1 2/2011 Kendall et al.
2011/0048743 A1 3/2011 Stafford et al.
2011/0061869 A1 3/2011 Abass et al.
2011/0079437 A1 4/2011 Hopkins et al.
2011/0127028 A1 6/2011 Strickland
2011/0139450 A1 6/2011 Vasques et al.
2011/0147013 A1 6/2011 Kilgore
2011/0162854 A1 7/2011 Bailey et al.
2011/0168443 A1 7/2011 Smolka
2011/0174537 A1 7/2011 Potter et al.
2011/0186298 A1 8/2011 Clark et al.
2011/0198075 A1 8/2011 Okada et al.
2011/0205652 A1 8/2011 Abbasi et al.
2011/0220409 A1 9/2011 Foppe
2011/0240314 A1 10/2011 Greenaway
2011/0266062 A1 11/2011 Shuman et al.
2011/0278070 A1 11/2011 Hopkins et al.
2011/0290563 A1 12/2011 Kocis et al.
2011/0303460 A1 12/2011 Von Rohr et al.
2012/0000646 A1 1/2012 Liotta et al.
2012/0012392 A1 1/2012 Kumar
2012/0012393 A1 1/2012 Kumar
2012/0020631 A1 1/2012 Rinzler et al.
2012/0048550 A1 3/2012 Dusterhoft et al.
2012/0048568 A1 3/2012 Li et al.

(56) References Cited

U.S. PATENT DOCUMENTS

| | | | | |
|---|---|---|---|---|
| 2012/0061091 | A1 | 3/2012 | Radi | |
| 2012/0067643 | A1 | 3/2012 | DeWitt et al. | |
| 2012/0068086 | A1 | 3/2012 | DeWitt et al. | |
| 2012/0068523 | A1 | 3/2012 | Bowles | |
| 2012/0074110 | A1 | 3/2012 | Zediker et al. | |
| 2012/0103693 | A1 | 5/2012 | Jeffryes | |
| 2012/0111578 | A1 | 5/2012 | Tverlid | |
| 2012/0118568 | A1 | 5/2012 | Kleefisch et al. | |
| 2012/0118578 | A1 | 5/2012 | Skinner | |
| 2012/0217015 | A1 | 8/2012 | Zediker et al. | |
| 2012/0217017 | A1 | 8/2012 | Zediker et al. | |
| 2012/0217018 | A1 | 8/2012 | Zediker et al. | |
| 2012/0217019 | A1 | 8/2012 | Zediker et al. | |
| 2012/0248078 | A1 | 10/2012 | Zediker et al. | |
| 2012/0255774 | A1 | 10/2012 | Grubb et al. | |
| 2012/0255933 | A1 | 10/2012 | Mckay et al. | |
| 2012/0261188 | A1 | 10/2012 | Zediker et al. | |
| 2012/0266803 | A1 | 10/2012 | Zediker et al. | |
| 2012/0267168 | A1 | 10/2012 | Grubb et al. | |
| 2012/0273269 | A1 | 11/2012 | Rinzler et al. | |
| 2012/0273470 | A1 | 11/2012 | Zediker et al. | |
| 2012/0275159 | A1 | 11/2012 | Fraze et al. | |
| 2014/0231398 | A1* | 8/2014 | Land | B23K 26/0093 219/121.72 |
| 2015/0308194 | A1* | 10/2015 | Moxley | E21B 7/14 175/16 |

OTHER PUBLICATIONS

Notification of Transmittal of International Preliminary Report on Patentability, PCT/US16/62004, dated Jan. 16, 2018, 9 pages.

* cited by examiner

METHOD OF MINING USING A LASER

BACKGROUND OF INVENTION

Related Applications

There are no patent applications related hereto filed in the United States, nor in any foreign country.

Field of Invention

The present invention relates to a method for mining. More specifically, the present invention relates to an improved method of using a high power laser for spalling a strata to facilitate extraction of sought after minerals from the spalled stratum chips.

BACKGROUND AND DESCRIPTION OF THE RELATED ART

Conventional rotary drilling methods for drilling holes in rock for mining and for gas and oil wells, use a rotary/vibratory drill bit interconnected to a long length of drill pipe, also called the drill string which is rotated by mechanical apparatus.

The drill bit may be constructed from a variety of materials, such as, but not limited to tungsten, carbide, steel, diamond, and the like. Drill bits are typically specialized for various rock/strata formations, hereinafter referred to as "stratum". Drill bits "wear out" and "break down" during drilling processes. Replacement of a drill bit requires removal of the drill string and drill bit from the drilled hole. To keep a drilled hole from collapsing inwardly upon itself, a casing may need to be installed and perhaps even cemented into the drilled hole.

Chips and rock fragments broken from the stratum by the friction and rotation of the drill bit within the drilled hole are removed from the drilled hole by pumping "drilling mud" at high pressure through an axial channel defined in the drill stem from the surface downwardly to the bottom of the hole being drilled. The drilling mud exits the drill stem through orifices defined in the drill bit. The high pressure exerted on the drilling mud passing through the drill stem causes the drilling mud, and chips and rock fragments, to be pushed, moved and floated upwardly along an exterior surface of the drill stem until the drilling mud and carried rocks/chips exit the drill hole at the point where the drill hole was initiated, typically at the surface. The use of drilling mud to remove rocks and chips from the drilled hole and also to cool the drill bit to prevent overheating adds a significant cost and complexity to drilling operations.

Reductions in drilling costs can be achieved by reducing requirements for drilling mud, drill string removal, drill bit replacement and setting of casings.

In underground mining operations, normally there are crosscuts driven from entry portals. From such crosscuts, drifts are mined following veins of ore. Drifts may be anywhere from two feet to over ten feet in width to any height the operator chooses, based on safe mining practices and height needed for mining equipment. The face of the drift is ordinarily prepared for blasting by drilling holes in a predetermined pattern and to a predetermined depth. The drilled holes are then packed with explosive media. The explosive charges are detonated to fracture the strata for removal of the sought after mineral and yet maintain the integrity of the strata and the drift. In many mines, the regular progression of daily drilling and blasting may exacerbate or induce "rock bursts". By eliminating drilling and blasting, mining is safer.

Lasers have been demonstrated to be effective in drilling and the rate of penetration of strata by lasers can be faster than current rates of penetration using mechanical drill bits. This saves drilling time and costs.

High power lasers can remove rock by vaporization, melting, and spallation which reduces the need for drilling mud to remove chips and fragments. Spallation is a rock removal process that utilizes a combination of laser-induced thermal stress and laser-induced superheated steam explosions just below the surface of the laser/rock interaction to fracture the rock into small fragments that can then be easily removed from the rock formation. High intensity laser energy, applied to a stratum causes the stratum surface temperature to increase instantaneously. This results in thermal stresses in the stratum subsurface. The laser energy also instantaneously vaporizes any moisture or liquid in the stratum subsurface. The explosion of the vaporized liquid creates significant mechanical stresses causing fractures. These laser-induced thermal and mechanical stresses spall the stratum which allows removal of the spalled chips with a vacuum.

Mine operators have continued their search for methods of removing valuable sought-after minerals between the drifts, particularly in narrow vein situations. The mining practices employed heretofore to extract such sought-after minerals are effective, but require considerable manpower and expense for the tonnage involved. At present, the difficulties and costs of mining to even greater depths following veins down dips has become less profitable and working conditions for the miners more difficult. The instant invention uses a single laser drill head, or plural cooperating laser drill heads in a mining array to operate cooperatively. The laser drill heads operatively communicate with a high power optical laser in the 1.6 to 2 kilowatt power range to spall/break roughly pea sized chips of material from a work surface.

Some or all of the problems, difficulties and drawbacks identified above and other problems, difficulties, and drawbacks may be helped or solved by the inventions shown and described herein. My invention may also be used to address other problems, difficulties, and drawbacks not set out above or which are only understood or appreciated at a later time. The future may also bring to light currently unknown or unrecognized benefits which may be appreciated, or more fully appreciated, in the future associated with the novel inventions shown and described herein.

BRIEF SUMMARY OF THE INVENTION

A method for mining using a high-power laser to instantaneously heat and sequentially rapidly cool stratum to cause spalling of the stratum which contains a sought after mineral.

One aspect of the instant method for mining using a laser to cause spalling includes the steps of generating and delivering a laser beam to a work surface of a geological strata having a sought after mineral to be removed from the stratum; moving the laser beam about three perpendicular axes so that a focal point of the laser beam moves across the working surface and rapidly increases the surface temperature of the working surface; providing a source of a cooling media, and delivering the cooling media to the working surface so as to rapidly cool the working surface subsequent to the rapid surface temperature increase generated by the laser beam so as to effect a fracturing of the working surface and to generate a plurality of chips from the working surface; and removing the chips spalled from the working surface.

A second aspect of the instant method for mining using a laser to cause spalling includes the steps of providing a geological strata having a sought after mineral to be removed; delivering a laser beam to a working surface of the geological strata the laser beam having a power output which is sufficient to spall small chips of the working surface of the geological strata; moving the laser beam along a predetermined path of travel across the working surface, and wherein the delivery of the laser beam to the working surface increases the surface temperature of the working surface; providing a source of a cooling media and delivering the cooling media to the working surface so as to cool the working surface temperature below a temperature which encourages spalling; removing at least in part, a portion of the spalled chips generated from the working surface; and delivering the removed spalled chips to a remote area for processing to remove the sought after mineral from the removed spalled chips.

A third aspect of the instant method for mining using a laser to cause spalling includes the steps of providing a geological stratum having a sought after mineral; providing a working surface of the stratum and upon which the method of mining may be operated; providing sources of compressed air, electrical energy and electromagnetic radiation; generating a laser beam with the sources of electricity and electromagnetic radiation, the generated laser beam having a power sufficient to cause a spalling of the stratum and sought after mineral forming the work surface; providing a flexible cable having a first end portion, and a second end portion, and wherein the first end portion of the flexible cable operatively communicates with the source of electromagnetic radiation, the source of compressed air, and the source of electrical energy; delivering the generated laser beam to the first end portion of the flexible cable for transmission therealong; providing a laser drill head having a first end portion and a second end portion, and wherein the second end portion of the laser drill head operatively communicates with the second end of the flexible cable and receives the electromagnetic radiation from the source of electromagnetic radiation, the laser beam which the flexible cable receives and passes therealong, the compressed air from the source of compressed air, and the electrical energy from the source of electrical energy; providing a rotating scanning head at the first end portion of the laser drill head which operatively communicates with the source of electromagnetic radiation, and wherein the rotating scanning head has a protective and transparent window at a first end portion, and plural, internal, reflective optical elements which are located in predetermined spaced relation relative to the protective transparent window and which are further contained within a body of the laser drill head, and wherein the reflective optical elements are individually controllably movable to transmit the laser beam through the protective transparent window and onto a spall area of the work surface, and which is proximate to the rotating scanning head, and wherein the laser beam is moved in a given pattern having a predetermined scanning time, and a predetermined dwell time, so as to cause spalling of the stratum which generates a multiplicity of spalled chips; delivering the compressed air to the rotating scanning head so as to both cool the internal, reflective optical elements, and the spall area subsequent to irradiation by the laser beam so as to thermally control the stratum and sought after mineral, and which further promotes the cooling of the spall area while inhibiting the melting and vaporization of the stratum and the sought after mineral; removing the spalled chips from the spall area by the use of the source of compressed air; providing a chip removal system having an evacuation port which is proximate to the rotating scanning head for evacuating the spalled chips from the spall area, and for propelling the spalled chips toward the second end of the laser drill head, and to a remote location for collection and processing; providing a drive unit to move the laser drill head along a predetermined path of travel relative to the work surface, and to further maintain a predetermined desirable distance between the rotating scanning head and the working surface so as to facilitate effective spalling and the generation of the spalled chips; and providing a controller operatively communicating with, and controllably coupled to the laser drill head, the drive unit, the source of electromagnetic radiation, the source of compressed air, the source of electrical energy, and the removal system, and wherein the controller is located remotely relative to the laser drill head, and further controls the operation of the laser drill head, the delivery of the compressed air, and the removal of the spalled chips by way of the chip removal system.

Other and further aspects of my invention will appear from the following specification and accompanying drawings which form a part hereof. In carrying out the aspects and objects of my invention it is to be understood that its structures and features and steps are susceptible to change in design and arrangement and order with only one embodiment being illustrated in the accompanying drawings and specified as is required.

BRIEF DESCRIPTION OF THE DRAWINGS

Disclosed forms, configurations, embodiments and/or diagrams relating to and helping to describe aspects and versions of our invention are explained and characterized herein, often with reference to the accompanying drawings. The drawings and features shown herein also serve as part of the disclosure of our invention, whether described in text or merely by graphical disclosure alone. The drawings are briefly described below.

DETAILED WRITTEN DESCRIPTION

Introductory Notes

Figure 1:
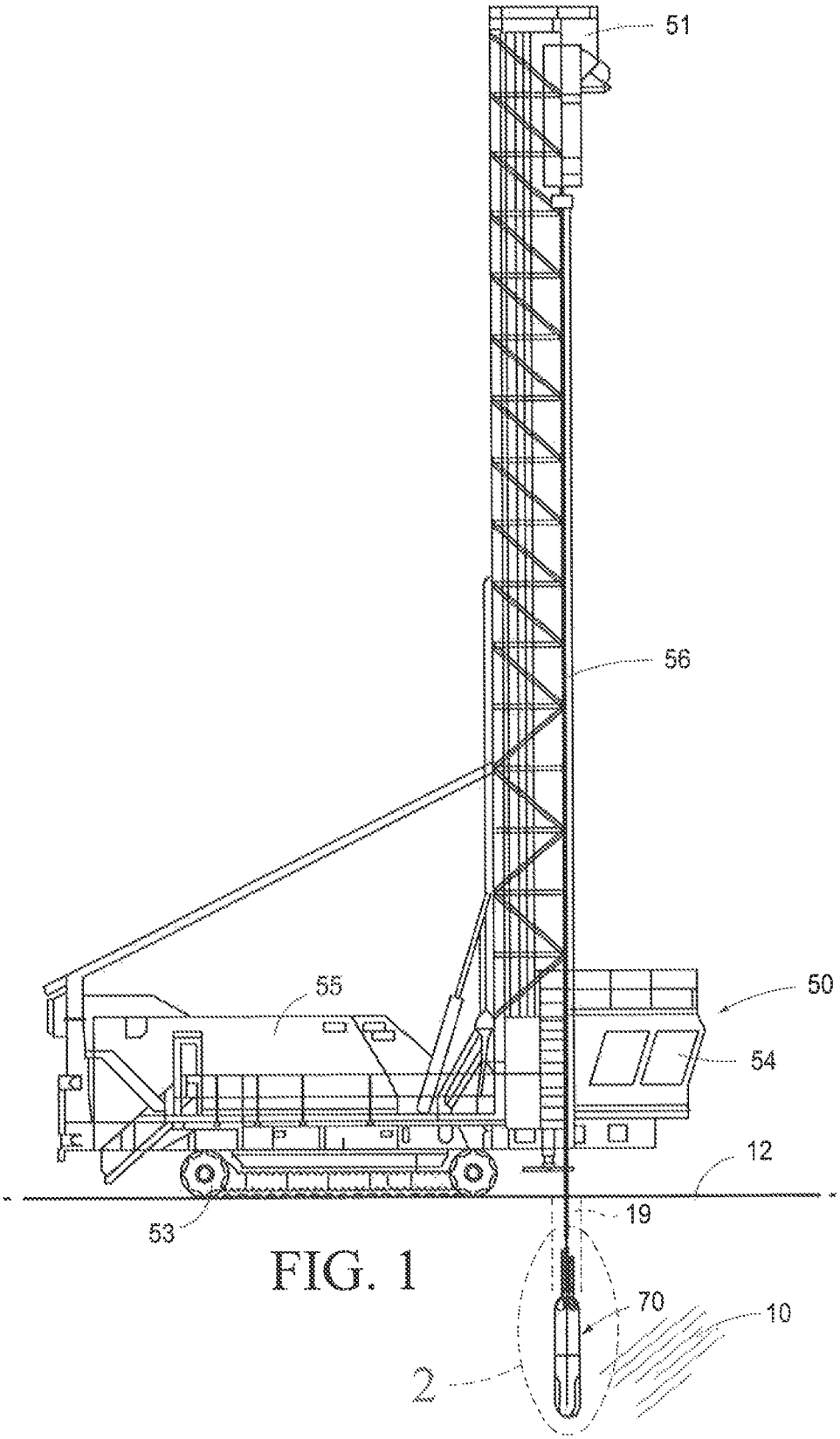
FIG. 1 is an orthographic side view of a drill rig carrying a vertically oriented drill string with a laser drill head within a borehole at a bottom terminal end portion of the drill string.

The readers of this document should understand that dictionaries were used in the preparation of this document. Widely known and used in the preparation hereof are *The American Heritage Dictionary of the English Language,* 4th Edition (©2000), Webster's New International Dictionary, Unabridged, (Second Edition ©1957), Webster's Third New International Dictionary (©1993). The Oxford English Dictionary (Second Edition, ©1989), and The New Century Dictionary (©2001-2005), all of which are hereby incorporated by this reference for interpretation of terms used herein and to more adequately or aptly describe various features, aspects and concepts shown or otherwise described herein using words having meanings applicable to such features, aspects and concepts.

This document is premised upon using one or more terms with one embodiment that may also apply to other embodiments for similar structures, functions, features and aspects of the inventions. Wording used in the claims is also descriptive of the inventions, and the text of both claims and abstract are incorporated by this reference into the description entirely.

My method for mining using a laser to cause spalling of a geological stratum 10 containing sought after mineral 11 which may be in the form of a vein 11*a*, or in the form of an ore 11*b* generally comprises a source of compressed air 20, a source of electrical energy 30, a source of electromagnetic radiation 40, an equipment transport vehicle 50, a flexible cable 60, a laser drill head 70, and a controller 250 with a user interface 251.

A working surface 12 of the geological stratum 10 and sought after mineral 11 is identified, and may be without limitation, a vertical surface, a horizontal surface, or an angulated surface and further maybe located, without limitation, within a mining shaft 16, a mining drift 17 or a mining winze 18. As noted previously, the sought after mineral 11 which may include, but not be limited to, gold, silver, platinum and the like may be in the form of a vein 11*a* within the stratum 10 or may be in the form of an ore 11*b*.

The equipment transport vehicle 50 may have a variety of configurations, but in the disclosed embodiment has moving means 53, such as, but not limited to, wheels and/or tracks to facilitate movement, carries an occupant compartment 54, and may also carry the source of compressed air 20, the source of electrical energy 30, the source of electromagnetic radiation 40 and the controller 250.

Figure 5:
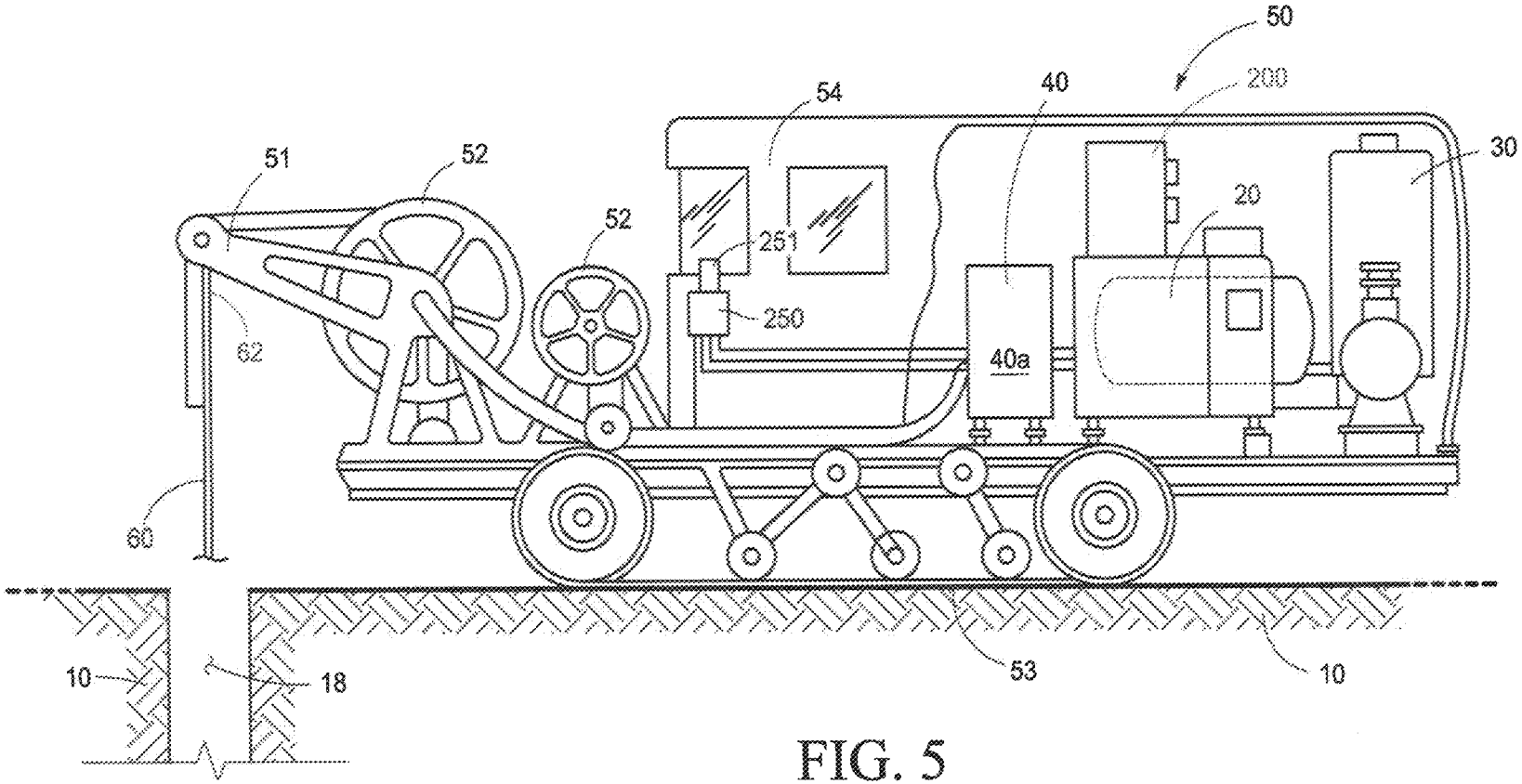
FIG. 5 is an orthographic, partial cutaway, side view of an equipment transport vehicle carrying an occupant compartment, the controller, the user interface, the source of electromagnetic radiation, the source of compressed air and the source of electrical energy as well as a hoist mechanism for the flexible cable communicating with the mining array.
Figure 6:
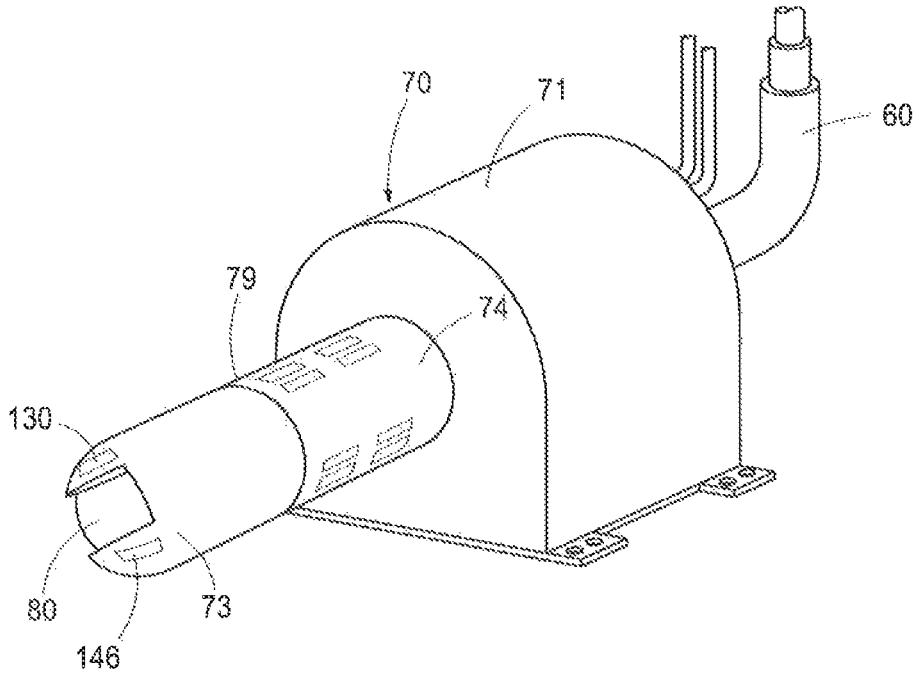
FIG. 6 is an isometric front, top and side view of one embodiment of a laser drill head for use on a mining array.

The source of compressed aft 20 is an aft compressor (FIG. 5) and the source of electrical energy 30 is a generator. (FIG. 5). The source of electromagnetic radiation 40 is contemplated to be a fiber laser 40*a* such as a YLS-2000 fiber laser which is commercially available and manufactured by companies such as, but not limited to, IPC Photonics, Inc. of Oxford, Mass., USA. The fiber laser 40*a* will operate in a power range of approximately 1.2 to about 2.4 kW, and preferably between about 1.6 kW and 2.0 kW. Transport of the source of compressed air 20, the source of electrical energy 30, the source of electromagnetic radiation 40, the controller 250 and the occupant compartment 54 by the equipment transport vehicle 50 allows my method of mining to be moved from location to location providing portability and maneuverability and ease of setup. Further, depending upon the type of mining to be performed, the equipment transport vehicle 50 may also include a crane mechanism 51 (FIG. 5) having a cable spool 52 rotatable about an axis (not shown) so as to efficiently and effectively store a length of the flexible cable 60 which allows for raising and lowering of the mining array 300. Further still, the equipment transport vehicle 50 may also be a drill rig 55 (FIG. 1) which may affix the laser drill head 70 to a lower end portion of a drill string 56. Attaching the laser drill head 70 to a drill string 56 is useful when a borehole 19 is being drilled.

The equipment transport vehicle 50, the source of compressed air 20, the source of electrical energy 30, the source of electromagnetic radiation 40 and the controller 250 may all be operated by an operator (not shown) within the occupant compartment 54 of the equipment transport vehicle 50 which provides the operator/occupant with protection and allows the operator to be located remotely from the actual mining operation and the work surface 12 which promotes worker safety. Remote location of the operator enhances safety because personnel need not be subjected to/exposed to noise, smoke, vapors, fumes, gases and rock bursts and the like that may be generated during mining operations.

The flexible cable 60 may be carried on the cable spool 52 and has a first end portion 61 and a second end portion 62. The flexible cable 60 defines multiple individual conduits 63 extending from the first end portion 61 to the second end portion 62 so that pressurized air from the source of pressurized air 20, electricity from the source of electrical energy 30, a laser beam 83 from the source of electromagnetic radiation 40 and other resources may be transmitted therealong from the first end portion 61 to the second end portion 62. The multiple individual conduits 63 may be hollow, such as for passage of solid or gaseous materials therethrough, or the individual conduits 63 may be solid (optical fiber, or wire) such as for passage of light or electricity therethrough. It is further contemplated the flexible cable 60 also includes shielding (not shown) to protect the individual conduits 63, and the contents thereof flowing or otherwise passing therethrough, from contents of adjacent conduits 63 so that, for example, the electricity passing through the flexible cable 60 does not negatively affect the laser beam 83 that is simultaneously passing through another conduit 63 of the flexible cable 60.

A high power fiber coupler 64 is carried at the first end portion 61 and at the second end portion 62 of the individual conduit 63 transmitting the laser beam 83 to provide operable interconnections with the source of electromagnetic radiation 40, at the first end portion 61, and an operable interconnection with the laser drill head 70, at the second end portion 62. High power fiber couplers 64 and collimators 77 are known in the industry and are commercially available from manufacturers such as, but not limited to, IPG Photonics, Inc. The high power fiber coupler 64 ensures that electromagnetic radiation, namely the laser beam 83, is not negatively affected by passing through a physical interconnection between operatively cooperating elements of the system.

The laser drill head 70 is operatively interconnected to the second end portion 62 of the flexible cable 60. The high power fiber coupler 64 interconnects the conduit 63 transmitting the laser beam 83 with a collimator 77 carried within the laser drill head 70. The laser drill head 70 may be positioned remotely from the equipment transport vehicle 50. The laser drill head 70 receives the generated laser beam 83, electricity (not shown) and pressurized air (not shown) through the flexible cable 60.

The laser drill head 70 has a body 71 which is generally somewhat cylindrical in configuration. The laser drill head body 71 has a rotating scanning head 76 at a first end portion 73 and an opposing second end portion 74. The flexible cable 60 and high power fiber coupler 64 interconnect with the second end portion 74. The rotating scanning head 76 rotates axially relative to the second end portion 74 at a circumferentially extending joint 79. The body 71 defines an interior chamber 72 and carries within the interior chamber 72, plural spacedly arrayed and individually controllably movable reflective optical elements 85, a laser beam collimator 77, plural azimuth drives 105, a cooling channel 120, an evacuation channel 135 as well as other various operating components including known electronics, pneumatic plumbing and connections therefore.

Figure 7:
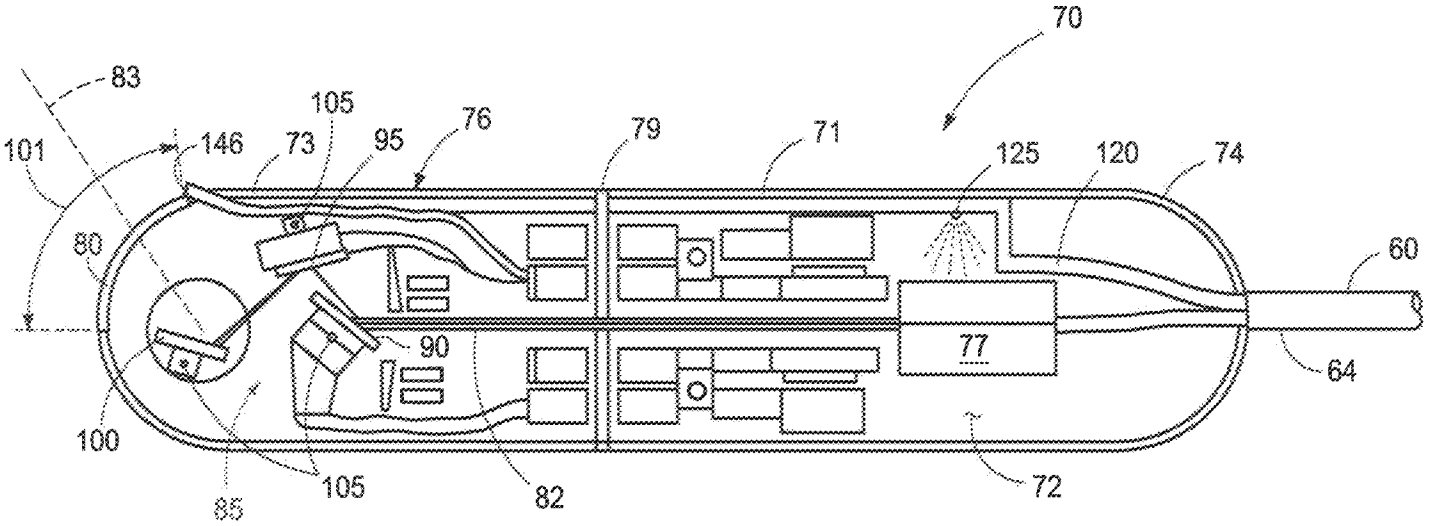
FIG. 7 is an orthographic partial cutaway side view of a laser drill head configured for borehole mining showing the internal components thereof.
Figure 8:
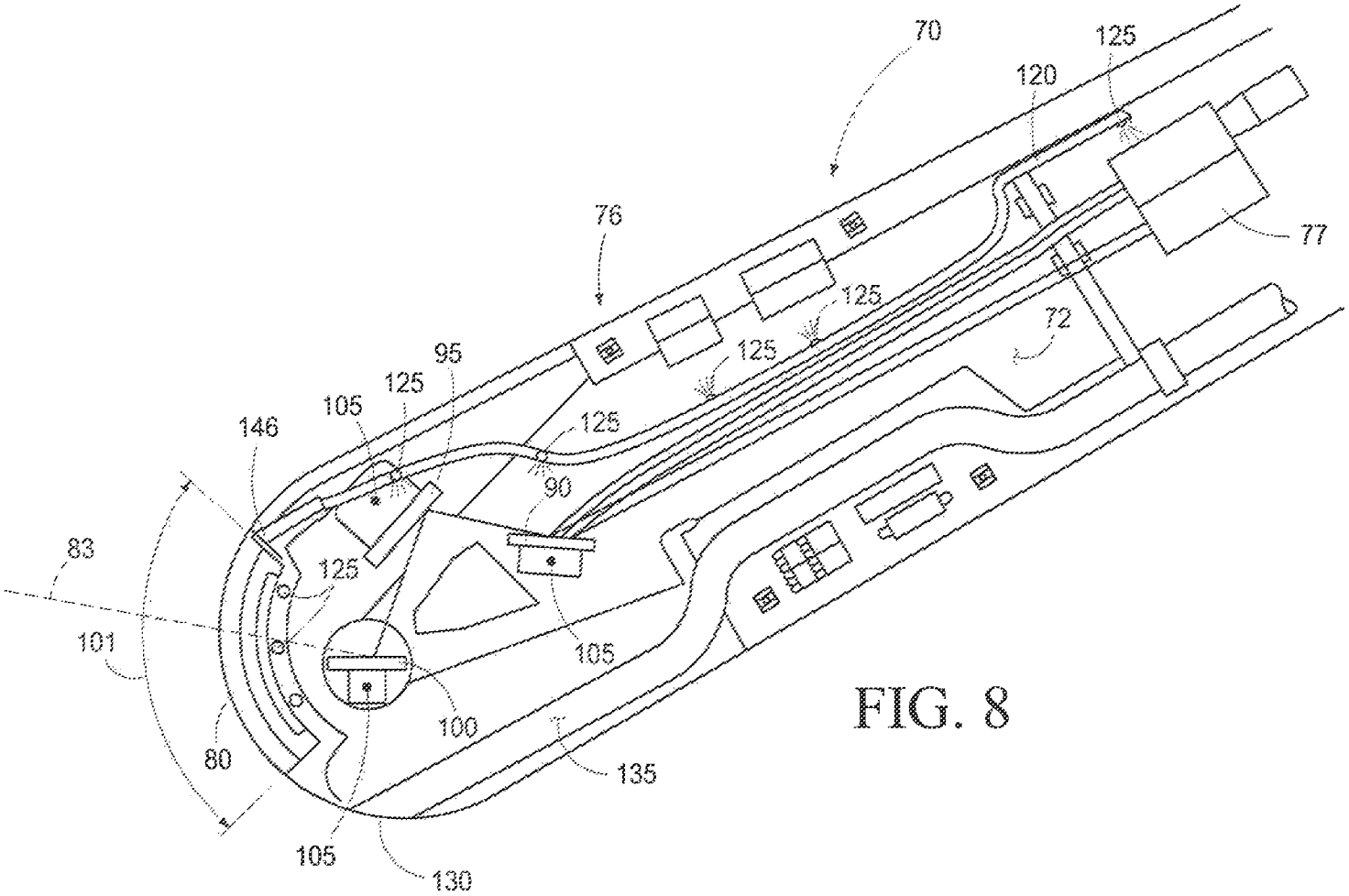
FIG. 8 is an enlarged orthographic partial cutaway side view of a laser drill head configured for borehole mining showing the internal components thereof.

The rotating scanning head 76 is rotated by a rotating means such as a servo controlled direct drive DC torque motor (not shown) which, when energized, causes the rotating scanning head 76 to rotate axially relative to the second end portion 74. Rotation of rotating scanning head 76 allows spall area 15 to be a semi-hemispherical shape. A protective transparent window 80 is carried at a first end portion of the rotating scanning head 76 opposite the flexible cable 60 and forms a transparent barrier through which the laser beam 83 may pass from the plural internal reflective optical elements 85 to the spall area 15 of the work surface 12. As shown in FIGS. 7 and 8, the plural reflective optical elements 85 include a folding mirror 90, an oscillating mirror 95 and a scanning mirror 100, all of which are mounted at predetermined locations and are movable on servo controlled azimuth drives 105 each of which allow +/−180° of travel. Each of the servo controlled azimuth drives 105 operatively communicates with and which are controlled by the controller 250 and user interface 251. Each of the mirrors 90, 95, 100 is comprised of a highly reflective coating (not shown) on a thermally stable substrate (not shown). The highly reflective coatings (not shown) are commercially available by manufacturers such as, but not limited to, ELCAN Optical Technologies, Inc. of Richardson, Tex., USA, but the formulation of the highly reflective coating is a proprietary trade secret of the manufacturer and not available for disclosure herein.

The physical positioning of the plural internal reflective optical elements 85 within the interior chamber 72 is such that the folding mirror 90, which has the highly reflective surface, receives the collimated laser beam 83 from the laser collimator 77. The laser beam 83 strikes the highly reflective surface of the folding mirror 90 and is reflected therefrom to the oscillating mirror 95 which similarly has a highly reflective surface thereon. The oscillating mirror 95 dithers at an adjustable rate to deviate the laser beam 83 by one beam diameter. The laser beam 83 received by the oscillating mirror 95 is thereafter reflected, from the reflective surface, to the scanning mirror 100 which similarly has a highly reflective surface thereon. The scanning mirror 100 is movable about an axis (not shown) so as to provide an elevation arc 101 of +22.5° to −22.5°. The elevation arc 101 of the scanning mirror 100 is controlled by an azimuth drive 105 and the controller 250. Movement of the scanning mirror 100 causes laser beam 83 to move back and forth about the elevation arc 101. The scanning mirror 100 is positioned spacedly adjacent inward of the protective transparent window 80 and within the interior chamber 72 of the rotating scanning head 76 so that the laser beam 83 reflecting off of the scanning mirror 100 is transmitted/passed through the protective transparent window 80 and onto the work surface 12 where the laser beam 83 irradiates the stratum 10 within the spall area 15. Rotation of the rotating scanning head 76, which includes the protective transparent window 80, in combination with the back and forth scanning of the laser beam 83 along the elevation arc 101 caused by the movement of the scanning mirror 100 causes the laser beam 83 to irradiate a generally circular area which is the spall area 15. Within the spall area 15, the laser beam 83 irradiates the stratum 10 and causes instantaneous heating of the stratum 10 which results in thermal fractures, instant vaporization of moisture and ultimate spalling which causes the work surface 12 spall area 15 to fracture and break forming small fragments, pieces and chips 150 approximately the size of a "pea". Rapid movement of the laser beam 83 across and about the spall area 15 with a predetermined scan time, and predetermined dwell time generates instantaneous heating and fracturing of the stratum 10 while minimizing vaporization and melting of the stratum 10 and/or melting/vaporization of the spalled chips 150 which would lead to destruction and loss of the sought after material 10.

The evacuation channel 135 and the cooling channel 120 are carried within the medial chamber 72 of the laser drill head 70. The cooling channel 120 receives pressurized air from the source of compressed air 20 which is carried to the laser drill head 70 through one of the conduits 63 defined in the flexible cable 60. The cooling channel 120 defines plural cooling orifices 125 within the medial chamber 72 so that pressurized air may be directed about and upon each of the plural internal reflective optical elements 85 as well as the collimator 77 to provide cooling thereto and thermal control thereof. An air curtain orifice 146 is defined in the rotating scanning head 76 proximate to the protective transparent window 80. The air curtain orifice 146 is configured into a nozzle that causes pressurized air emitted from the air curtain orifice 146 to form an air curtain (not shown) over and about an exterior surface of the protective transparent window 80. The air curtain (not shown) protects the transparent window 80 from dust, debris, spalled chips 150 and the like generated from the spalling. The air curtain (not shown) simultaneously "pushes" the spalled debris and chips 150 away from the work surface 12 and also cools the exterior surface of the transparent window 80 and the work surface 12. The air curtain orifice 146 pneumatically communicates with the cooling channel 120 and likewise with the source of compressed air 20 which is located remotely from the laser drill head 70.

An evacuation port 130 is also defined in the rotating scanning head 76 proximate to the protective transparent window 80 and preferably spaced apart from the air curtain orifice 146. The evacuation port 130 communicates with the evacuation channel 135 which is carried within and extends through the interior chamber 72 of the laser drill head 70 from the first end portion 73 to the second end portion 74 and provides a means by which chips 150 spalled from the work surface 12 are removed from the spall area 15 and moved toward the second end portion 74 of the laser drill head 70 and thereafter transported to a distal location by means of a chip removal system 200 for further processing. The evacuation port 130 functions as a vacuum head to remove the spalled chips 150 from the work surface 12.

Figure 4:
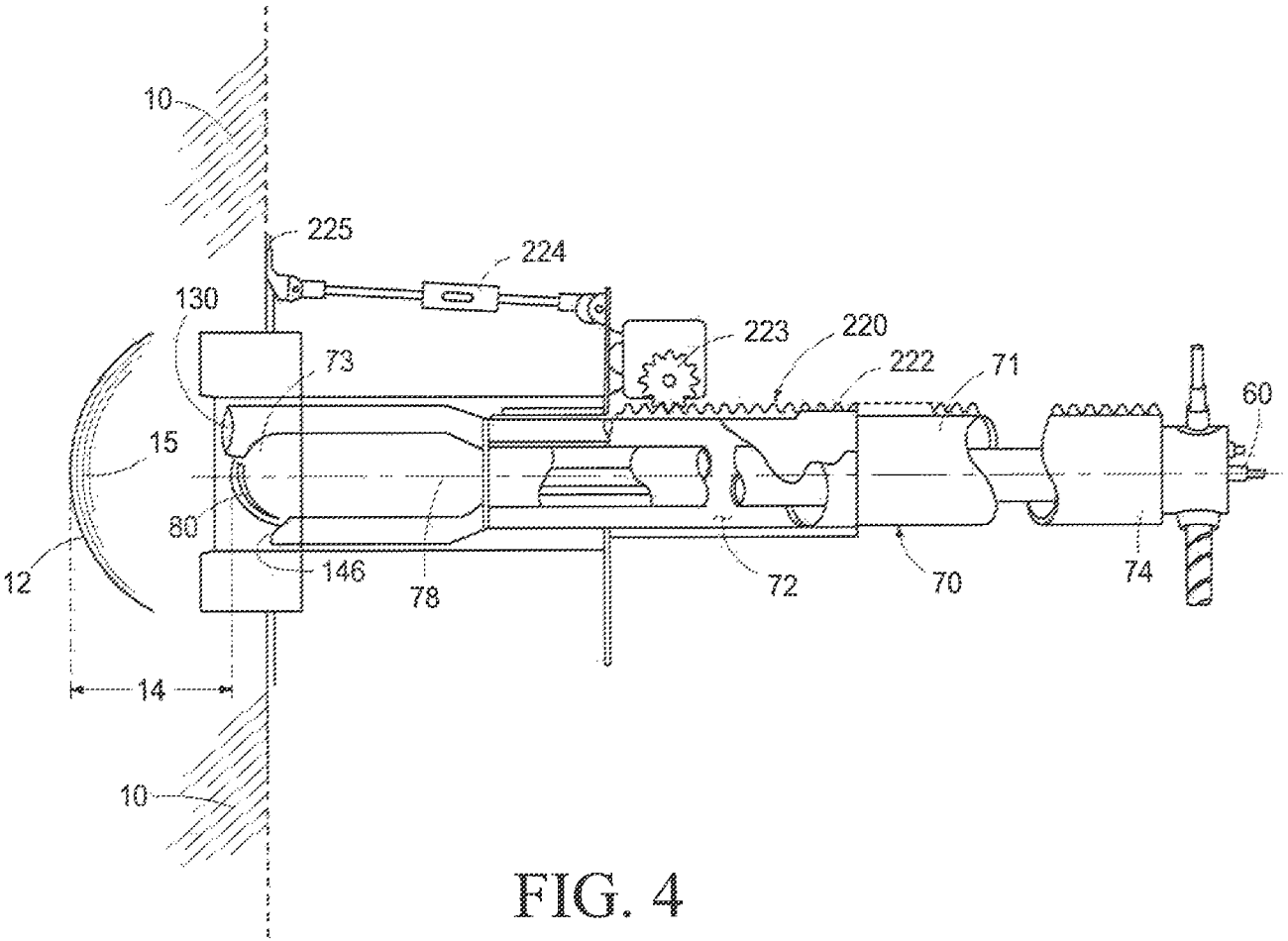
FIG. 4 is an orthographic partial cutaway side view of a laser drill head with a transverse drive mechanism attached to a vertical work surface.

Depending upon the configuration of the laser drill head 70 being used, a drive unit 220 be carried on an external surface of the laser drill head 70. (See FIG. 4). The drive unit 220, which communicates with the controller 250 and user interface 251, allows the laser drill head 70 to be moved axially forwardly and rearwardly to maintain a desirable predetermined distance 14 between the rotating scanning head 76 and the spall area 15 on the work surface 12. Maintaining the predetermined desirable distance 14 between the rotating scanning head 76 and the spall area 15 facilitates effective performance of the laser drill by maintaining an infinite focal length laser beam 83 which projects the laser beam energy on the spall area 15 surface. In the presently disclosed embodiment, the predetermined desirable distance 14 is between approximately 75 mm and 250 mm, and more preferably between approximately 100 mm and 200 mm. In the current embodiment, the drive unit 220 is a transverse drive unit 221 having plural pneumatic actuators 224 that expand and contract axially, and a face attachment 225 affixed to the work surface 12. In other contemplated embodiments, the drive unit 220 may comprise a stationary gear rack 222 and a rotating gear 223 that operatively communicate with one another. The face attachment 225 is releasably positionally secured to the work surface 12 spacedly adjacent the spall area 15. The actuators 224 communicate between the face attachment 225 and the laser drill head body 71. The actuators 224 axially expand and axially contract responsive to pneumatic pressure supplied thereto causing the laser drill head 70 to move axially forwardly and rearwardly as controlled by the controller 250.

In the second contemplated embodiment, the rotatable gear 223 operatively engages with the gear rack 222 carried by the laser drill head body 71. Rotation of the gear 223 engaged with the gear rack 222 causes the laser drill head 70 to move relative to the work surface 12 so that the predetermined desirable working distance 14 may be maintained. The drive unit 220 operatively communicates with the controller 250 by means of the flexible cable 60 so that an operator, located distally from the laser drill head 70, may control the movement of the laser drill head 70 by operation of the drive unit 220.

As chips 150 are spalled from the work surface 12 spall area 15 and the borehole 19 increases in depth, the laser drill head 70 is advanced forwardly, by axial expansion of the actuators 224, or rotation of the gear 223, to continuously maintain the predetermined desirable distance 14 between the rotating scanning head 76 and the spall area 15.

The prior disclosed configuration of my laser drill head 70 is useful when a borehole 19 is being drilled, such as for later packing with explosives for blasting, or when the laser drill head 70 is attached to a terminal end portion of a drill stem 56 operated by a drill rig 55. (FIG. 1).

Figure 3:
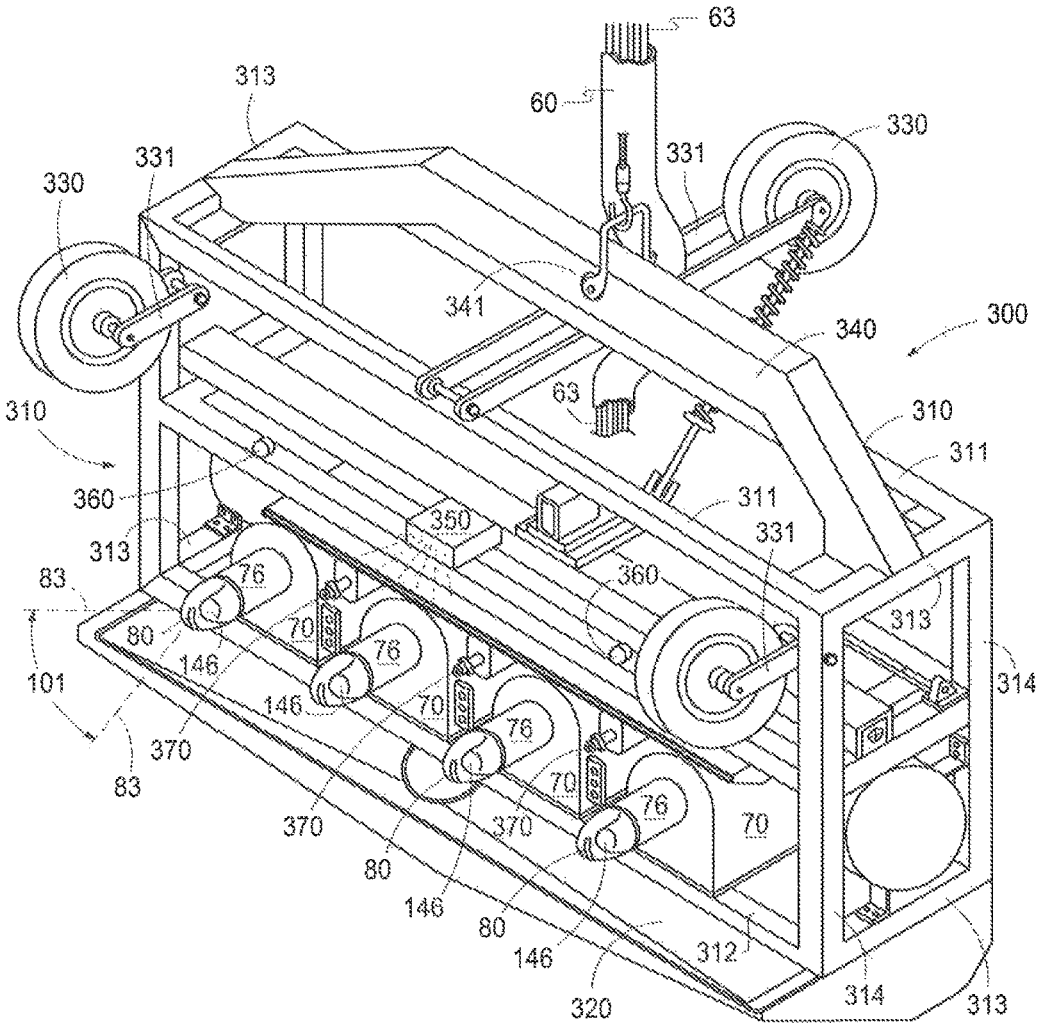
FIG. 3 is an isometric top, front and side view of a mining array carrying four spacedly adjacent laser drill heads, and x-ray fluorescence emitter; receiver, illumination devices, video cameras and a chip receiver.
Figure 9:
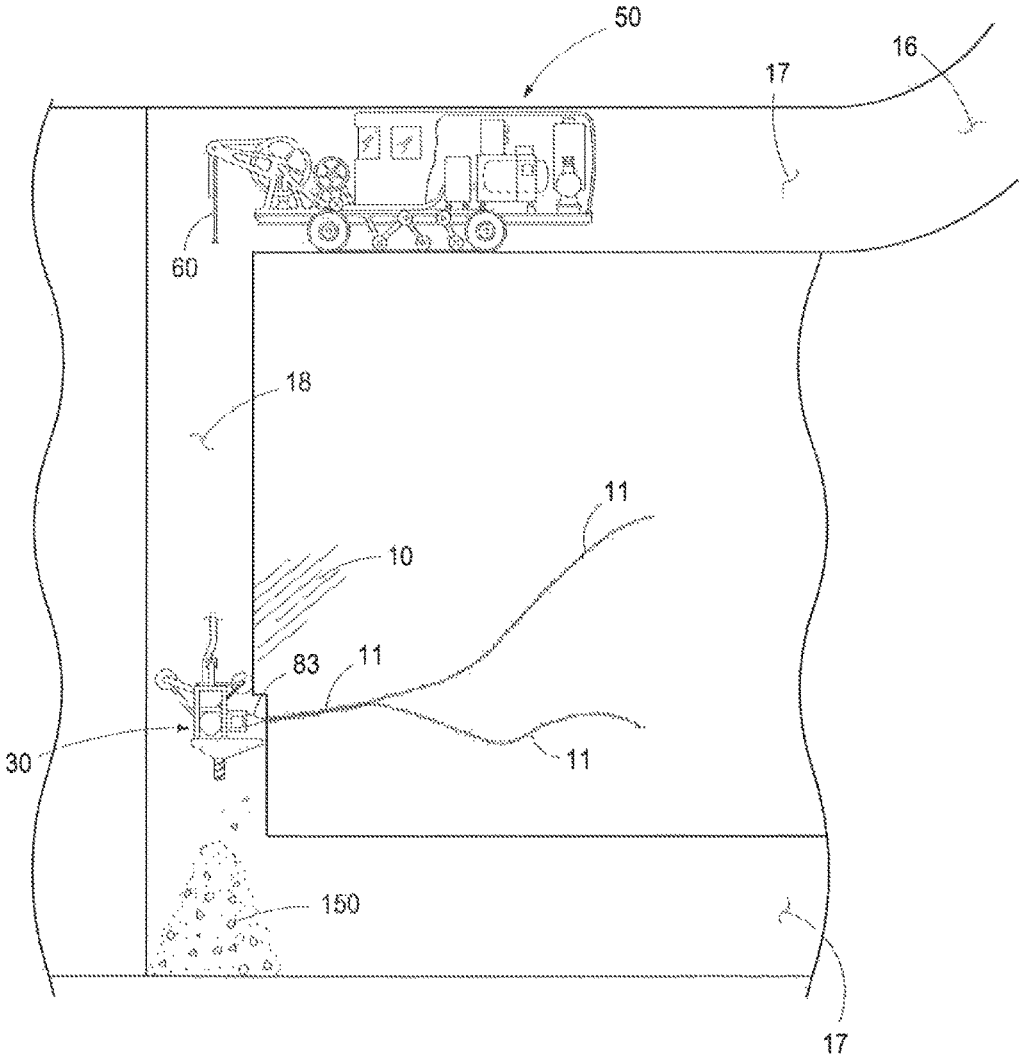
FIG. 9 is an orthographic schematic diagram of an equipment transport vehicle lowering a mining array into a mining winze and the mining array commencing laser mining therein.

In a second contemplated embodiment, as shown in FIG. 3, plural laser drill heads 70 may be carried upon a mining array 300 to cause spallation over and aerially larger spall area 15 which may be useful when the sought after mineral 11 is contained within an ore 11*b* type stratum 10. (FIG. 9). The mining array 300 (FIG. 3) has a frame 310 that is generally rectilinear having two horizontally spaced upper beams 311 and two horizontally spaced lower beams 312, the upper beams 311 and the lower beams 312 each having opposing end portions. A horizontal transverse beam 313 extends between the spacedly adjacent end portions of the two upper beams 311, and also between the spacedly adjacent end portions of the two lower beams 212 to maintain the upper beams 311 and the lower beams 312 in horizontal parallel spaced adjacency. Vertical spacing beams 314 structural interconnect the adjacent end portions of the upper beams 311 and the lower beams 312 to form the generally rectilinear frame 310. A cable mount arch 340 extends parallel to the two spaced apart upper beams 311 and interconnects at its end portions with the upper horizontal transverse beams 313 at generally medial positions thereon. The arch 340 supports a cable mount 341 for releasable engagement with the flexible cable 60 carried by the equipment transport vehicle 50 and its crane mechanism 51. A chip receiver 320 is carried vertically below the two spaced apart lower beams 312 to receive spalled chips 150 from the spall area 15. The chip receiver 320 may be configured with individual storage compartments (not shown) and also with trapdoors (not shown) to allow spalled chips 150 to pass therethrough. The individual storage compartments (not shown) and the trapdoors (not shown) may be operable by an operator using the controller 250 and operator interface 251 to ensure that sought-after minerals 11 are collected in the chip receiver 320 while mining waste is allowed to pass through the trapdoor (not shown) or allowed to drop to a lower drift 17.

Spacing wheels 330 on shock absorbing mounts 331 facilitate movement of the mining array 300 along the work surface 12 and assist in maintaining the desirable predetermined distance 14 between the rotating scanning head 76 and the spall area 15 to facilitate effective spalling (FIG. 9) which necessitates that the focal point of the laser beams 83 be upon the spall area 15.

Plural laser drill heads 70 may be carried on the frame 310 and the plural laser drill heads 70 are positioned thereon so that the spall area 15 formed by each laser drill head 70 is immediately adjacent to the spall area 15 of an adjacent laser drill head 70 causing spalling across a larger area, such as when large volumes of ore 11*b* are being removed.

An x-ray fluorescence emitter/receiver 350, an illumination device 360 and a video camera 370 may be carried by the frame 310. The x-ray fluorescence emitter/receiver 350 emits predetermined wavelength of electromagnetic radiation upon the work surface 12 causing reflectivity, illumination, and luminescence of various desirable sought-after minerals 11 present within the stratum 10. The receiver portion/function of the x-ray fluorescence emitter/receiver 350, such as those manufactured by Olympus Corporation, receives the reflected/emitted electromagnetic radiation from the sought after mineral 11 and registers the receipt of such reflected electromagnetic radiation which is indicative of the presence and concentration/density of the sought after mineral 11. The presence of the sought after mineral 11 is thereupon operatively communicated to the controller 250 and user interface 251 being monitored by an operator. The illumination device 360 provides light that is projected upon the work surface 12 which allows the video camera 370 to record and monitor operations of the spalling generated by the laser drill heads 70. Video information recorded by the video camera 370 is communicated/transmitted to the controller 250 and the user interface 251 for monitoring by an operator at a remote location, typically in the equipment transport vehicle 50.

Figure 2:
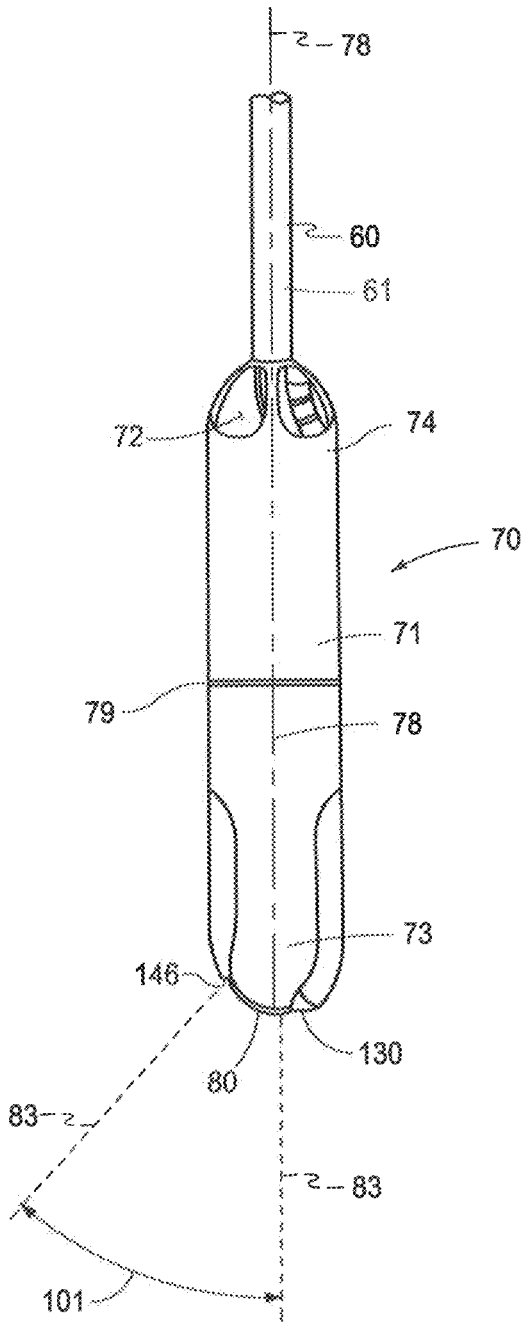
FIG. 2 is an enlarged orthographic side view of the laser drill head of FIG. 1.

The physical configuration of the individual plural laser drill heads 70, when mounted on the mining array 300 may be somewhat different than the laser drill heads 70 configuration used for borehole mining (FIG. 2) since it is not necessary that the laser drill heads 70 mounted on the mining array 300 to have drive units 220 because the position of the mining array 300 is controlled by the controller 250, the crane mechanism 51 and also by the spacing wheels 330.

The pressurized air (not shown) supplied by the source of compressed air 20 is emitted through the air curtain orifice 146 and onto the work surface 12. The pressurized air (not shown) impacting the work surface 12 cook the span area 15 immediately after it is irradiated by the laser beam 83 and instantaneously heated to extreme temperatures causing rapid expansion of the stratum 10. The immediate subsequent cooling of the stratum 10 by the pressurized air (not shown) causes rapid contraction of the stratum 10 which leads to the spalling of the work surface 12 and formation of chips 150 which are removed therefrom. It is the rapid extreme heating and rapid extreme cooling that generates the spalling of the work surface 12.

As shown in FIG. 9 the mining array 300 is configured for spallation mining in vertical shafts 16, and also in angulated drifts 17 and in winzes 18 where the mining array 300 is movable by gravity, and also by the crane mechanism 51 of the equipment transport vehicle 50. The mining array 300 is therefore movable in two opposing directions, in a first direction by gravity, and in a second direction opposite gravity. The spring wheels 330 maintain the predetermined desirable distance 14 between the rotating scanning heads 76 and the work surface 12 as the mining array 300 is moved in both directions and spallation mining continues.

A proximity switch (not shown) carried by the mining array 300 is used to monitor and maintain the predetermined desirable distance 14 from the rotating scanning head 76 of each laser drill head 70 to the work surface 12 for optimum operation, so that the focal point (not shown) of each laser beam 83 irradiates the work surface 12. Movement of the spacing wheels 330 in response to operation of the crane mechanism 51 is computer controlled. Operator control of the video cameras 370, illumination device 360, x-ray fluorescence emitter/receiver 350 and the crane mechanism 51 allows the operator to analyze the direction and width of narrow veins 11*a* and selectively program the laser drill heads 70 to cut out only the desired mineral 11.

Subsequent passes of the mining array 300 maybe used to remove the remaining stratum 10.

The equipment transport vehicle 50 carries the necessary computers to control the laser drill head 70 operation, the optical mirrors servo system (not shown), face mapping data generated by video cameras 370, the x-ray fluorescence emitter/receiver 350, as well as the operational controls for the pressurized air (not shown), and the chip removal system 200 and chip receiver 320 of the mining array 300. The equipment transport vehicle 50 mounts the necessary number sources of electromagnetic radiation 40 and other operating equipment, such as, but not limited to, fiber optic cables 60*a*, electronic and electrical cables and compressed air hose and the associated winches. On board electrical power generation 30, liquid petroleum gas (LPG) tanks to fuel the source of electrical energy 30, source of pressurized air 20 and associated equipment. On board electrical power generation 30, liquid petroleum gas (LPG) or other appropriate material holding tanks (not shown) to fuel the source of electrical energy 30 also supplies power for the equipment transport vehicle 50 drive means 53 and systems (not shown) for operator comfort within the occupant compartment 54.

The apparatus consists of a fiber laser 40*a*, a flexible cable 60 having a fiber optic cable 60*a* conduit 63 capable of transmitting up to at least 2 kW of optical power over a distance of up to approximately 500 feet as well as a gaseous supply conduit 63 capable of flowing at least approximately 100 CFM at 100 psi, and a shielded conduit 63 capable of transmitting sufficient electrical power over the distance of approximately 500 feet to operate servo controlled azimuth drives 105 and positional location devices (not shown), illumination devices 360, video cameras 370, electronic controls and signal return tables for the mining array 300 components.

The laser beam 83 is transmitted through the fiber-optic cable 60*a* from the first end portion 61 which communicates with the fiber laser 40*a*, to the second end portion 62 which communicates with the collimator 77 within the laser drill head 70, A high power fiber coupler 64 interconnects the first end portion 61 of the fiber-optic cable 60*a* with the fiber laser 40*a* and a second high power fiber coupler 64 interconnects the second end portion 62 of the fiber-optic cable 60*a* with a collimator 77 carried within the laser drill head 70. The collimator 77 encloses the beam expanding optical elements (not shown) and beam collimating optical elements (not shown). Cooling orifices 125 communicating with the source of compressed air 20 operatively communicate with the collimator 77 so that pressurized cooling air flows onto and around the optical elements to provide cooling.

As the expanded, collimated laser beam 83 exits the collimator 77, which is carried within the laser drill head 70, the laser beam 83 is directed to a folding mirror 90 which is coated with a highly reflective (proprietary to the supplier) coating in a wavelength of the laser beam 83. The folding mirror 90 is mounted on a set of pivots (not shown) and a servo controlled azimuth drive 105 to allow the position and angle of the folding mirror 90 to be adjusted as necessary to rapidly translate the laser beam 83 one half of a beam diameter. The folding mirror 90 is electronically driven by the controller 250 such that its frequency of translation can be altered either by a predetermined controller 250 control or based upon feedback from other instrumentation. Control software (not shown) will also provide fine control over the translation of the folding mirror 90 to manage the total travel of the laser beam 83 on the spall area 15.

The laser beam 83 is then directed to the oscillating mirror 95 which is also adjustably mounted on a servo controlled azimuth drive 105 and which is also coated with a highly reflective coating in the wavelength of the laser beam 83.

The laser beam 83 is then directed to a scanning mirror 100 which is similarly coated with a highly reflective coating in the wavelength of the laser beam 83 and which is also mounted on a servo controlled azimuth drive 105.

Finally, the laser beam 83 passes through the protective transparent window 80 which is protected by the air curtain (not shown) of pressurized air to allow the laser beam 83 to irradiate the spall area 15. All three of the mirrors 90, 95, 100 are separately mounted on servo controlled azimuth drives 105 which communicate with the controller 250. The laser beam 83 is thus able to be directed, based on the diameter of the collimated laser beam 83 upon the selected spall area 15. All three mirrors 90, 95, 100 receive a stream of cooling gas which is supplied by the cooling orifices 125 directed upon the mirrors 90, 95, 100. The cooling gas is subsequently exhausted from the laser drill head 70 to assist in forming the air curtain (not shown) exteriorly of the protective transparent window 80. An additional high-pressure air nozzle (not shown) may be carried proximate to the air curtain orifice 146 to direct a stream of cooling gas upon the spall area 15 to deflect chips 150 and to absorb any excess vapors.

Having described my method of mining, its operation may be understood.

In use, an appropriately sized mining array 300 will be lowered from the upper drift 17. The laser beams 83, directed by the rotating scan heads 76 will irradiate the work surface 12 and begin cutting/spalling chips 150 which are collected into a chip receiver 320 and subsequently may be dropped by means of gravity to a lower drift 17. Ore 11*b* may be separated from waste in the chip receiver 320, by selective cutting. Waste material may be retained, mixed or sprayed with cement or a resin additive, and delivered directly behind a form to create an "in-place" backfill system.

One aspect of the instant method of comprises generating and delivering a laser beam 83 to a working surface 12 of a geological stratum 10 having a sought after mineral 11 to be removed; moving the laser beam 83 about three perpendicular axes so that a focal point of the laser beam 83 moves across the working surface 12, and rapidly increases the surface temperature of the working surface 12; providing a source of a cooling media 20, and delivering the cooling media to the working surface 12 so as to rapidly cool the working surface 12 subsequent to the rapid surface temperature increase generated by the laser beam 83 so as to effect a fracturing of the working surface 12 and to generate a plurality of chips 150 from the working surface 12; and removing the chips 150 spalled from the working surface 12.

A second aspect of the instant method of mining comprises: providing a geological stratum 10 having a sought after mineral 11 to be removed; delivering a laser beam 83 to a working surface 12 of the geological stratum 10 and which has a power output which is sufficient to spall small chips 150 of the working surface 12 of the geological stratum 10; moving the laser beam 83 along a predetermined path of travel across the working surface 12, and wherein the delivery of the laser beam 83 to the working surface 12 increases the surface temperature of the working surface 12; providing a source of a cooling media 20, and delivering the cooling media to the working surface 12 so as to maintain the working surface 12 temperature below a temperature which encourages spalling; removing at least in part, a portion of the spalled chips 150 generated from the working surface 12; and delivering the removed spalled chips 150 to a remote area.

A third aspect of the instant method of mining comprises providing a geological stratum 10 having a sought after mineral 11; providing a working surface 12 of the stratum 10 and upon which the method of mining may be operated; providing sources of compressed aft 20, electrical energy 30 and electromagnetic radiation 40; generating a laser beam 83 with the sources of electricity 30 and electromagnetic radiation 40, and which has a power sufficient to cause a spalling of the stratum 10 and sought after mineral 11 forming the work surface 12; providing a flexible cable 60 having a first end portion 61, and a second end portion 62, and wherein the first end portion 61 operatively communicates with the source of electromagnetic radiation 40, the source of compressed air 20, and the source of electrical energy 30; delivering the laser beam 83 to the first end portion 61 of the flexible cable 60 for transmission therealong; providing a laser drill head 70 having a first end portion 73 and a second end portion 74, and wherein the second end portion 74 of the laser drill head 70 operatively communicates with the second end portion 62 of the flexible cable 60 and further receives the electromagnetic radiation from the source of electromagnetic radiation 40, the laser beam 83 which the flexible cable 60 receives, and passes therealong, the compressed air from the source of compressed air 20, and the electrical energy from the source of electrical energy 30; providing a rotating scanning head 76 at the first end portion 73 of the laser drill head 70 and which operatively communicates with the source of electromagnetic radiation 40, and wherein the rotating scanning head 76 has a protective and transparent window 80 at a first end portion 73, and plural, internal, reflective optical elements 85 which are located in predetermined spaced relation relative to the protective transparent window 80 and which are further contained within a body 70 of the laser drill head 70, and wherein the reflective optical elements 85 are individually controllably movable to transmit the laser beam 83 through the protective transparent window 80, and onto a spall area 15 of the work surface 12, and which is proximate to the rotating scanning head 76, and wherein the laser beam 83 is moved in a given pattern having a predetermined scanning time, and a predetermined dwell time, so as to cause palling of the stratum 10 and which generates a multiplicity of spalled chips 150, and a removal of the sought after mineral 11 from the spall area 15; delivering the compressed air to the rotating scanning head 76 so as to both cool the internal, reflective optical elements 85, and the spall area 15 which is being irradiated by the laser beam 83 so as to thermally control the stratum 10 and sought after mineral 11, and which further promotes the cooling of the spall area 15 while inhibiting the melting and vaporization of the stratum 10 and the sought after mineral 11; removing the spalled chips 150 away from the spall area 15 by the use of the source of compressed air 20; providing a removal system 200 having an evacuation port 130 which is proximate to the rotating scanning head 76 for evacuating the spalled chips 150 from the spall area 15, and for propelling the spalled chips 150 toward the second end portion 75 of the laser drill head 70, and to a remote location for collection and processing; providing a drive unit 220 to move the laser drill head 70 along a predetermined path of travel relative to the work surface 12, and to further maintain a predetermined desirable distance 14 between the rotating scanning head 70 and the working surface 12 so as to facilitate effective spalling and the generation of the spalled chips 150; and providing a controller 250 operatively communicating with, and controllably coupled to the laser drill head 70, the drive unit 220, the source of electromagnetic radiation 40, the source of compressed air 20, the source of electrical energy 30, and the removal system 200, and wherein the controller 250 is located remotely relative to the laser drill head 70, and further controls the operation of the laser drill head 70, the delivery of the compressed air, and the removal of the spalled chips 150 by way of the removal system 200.

Various portions and components of the instant invention, including for example, but not limited to, structural components, can be formed by one or more various manufacturing processes known to those in the art.

This disclosure and description has set out various features, functions, methods capabilities, uses and other aspects of our invention. This has been done with regard to the currently preferred embodiments thereof. Time and further development may change the manner in which the various aspects are implemented.

The scope of protection accorded the inventions as defined by the claims is not intended to be limited to the specific sizes, shapes, features or other aspects of the currently preferred embodiments shown and described. The claimed inventions may be implemented or embodied in other forms while still being within the concepts shown, disclosed, described and claimed herein. Also included are equivalents of the inventions which can be made without departing from the scope of concepts properly protected hereby.

Having thusly described and disclosed my method of mining, I file this Utility Patent Application and pray issuance of Utility Letters Patent.

I claim:

1. A method of mining comprising:

providing a stratum having a sought after mineral;

providing a working surface of the stratum and upon which the method of mining may be operated;

providing sources of compressed air, electrical energy and electromagnetic radiation;

generating a laser beam with the sources of electricity and electromagnetic radiation, and which has a power sufficient to cause a spalling of the stratum and sought after mineral forming the work surface;

providing a flexible cable having a first end portion, and a second end portion, and wherein the first end portion operatively communicates with the source of electromagnetic radiation, the source of compressed air, and the source of electrical energy;

delivering the laser beam to the first end portion of the flexible cable for transmission therealong;

providing a laser drill head having a first end portion and a second end portion, and wherein the second end portion of the laser drill head operatively communicates with the second end of the flexible cable and further receives the electromagnetic radiation from the source of electromagnetic radiation, the laser beam which the flexible cable receives, and passes therealong, the compressed air from the source of compressed air, and the electrical energy from the source of electrical energy;

providing a rotating scanning head at the first end portion of the laser drill head and which operatively communicates with the source of electromagnetic radiation, and wherein the rotating scanning head has a protective and transparent window at a first end portion, and plural, internal, reflective optical elements which are located in predetermined spaced relation relative to the protective transparent window and which are further contained within a body of the rotating scan head, and wherein the reflective optical elements are individually controllably movable to transmit the laser beam through the protective transparent window, and onto a spall area of the work surface, and which is proximate to the rotating scanning head, and wherein the laser beam is moved in a given pattern having a predetermined scanning time, and a predetermined dwell time, so as to cause spalling of the stratum and which generates a multiplicity of spalled chips, and a removal of the sought after mineral from the spall area;

delivering the compressed air to the rotating scanning head so as to both cool the internal, reflective optical elements, and the spall area which is being irradiated by the laser beam so as to thermally control the stratum and sought after mineral, and which further promotes the cooling of the spall area while inhibiting the melting and vaporization of the stratum and the sought after mineral;

removing the spalled chips away from the spall area by the use of the source of compressed air;

providing a removal system having an evacuation port which is proximate to the rotating scanning head for evacuating the spalled chips from the spall area, and for propelling the spalled chips toward the second end of the laser drill head, and to a remote location for collection and processing;

providing a drive unit to move the laser drill head along a predetermined path of travel relative to the work surface, and to further maintain a predetermined desirable distance between the rotating scanning head and the working surface so as to facilitate effective spalling and the generation of the spalled chips; and providing a controller operatively communicating with, and controllably coupled to the laser drill head, the drive unit, the source of electromagnetic radiation, the source of compressed air, the source of electrical energy, and the removal system, and wherein the controller is located remotely relative to the laser drill head, and further controls the operation of the laser drill head, the delivery of the compressed air, and the removal of the spalled chips by way of the removal system.

2. The method of mining as claimed in claim 1 and wherein the sought after mineral is contained within a vein.

3. The method of mining as claimed in claim 1 and wherein the sought after mineral is within an ore.

4. The method of mining as claimed in claim 1 and wherein the working surface is vertical.

5. The method of mining as claimed in claim 1 and wherein the working surface is horizontal.

6. The method of mining as claimed in claim 1 and wherein the working surface is angular.

7. The method of mining as claimed in claim 1 and wherein the working surface is in a shaft.

8. The method of mining as claimed in claim 1 and wherein the working surface is in a drift.

9. The method of mining as claimed in claim 1 and wherein the working surface is in a winze.

10. The method of mining as claimed in claim 1 and wherein the source of electromagnetic radiation generates a laser beam having between approximately 1.4 kW of power and approximately 2.4 kW of power.

11. The method of mining as claimed in claim 1 and wherein the source of electromagnetic radiation generates a laser beam having a power of about 1.6 kW to about 2.0 kW.

12. The method of mining as claimed in claim 1 and wherein the source of electromagnetic radiation is a fiber laser.

13. The method of mining as claimed in claim 1 and wherein the flexible cable has multiple lumens.

14. The method of mining as claimed in claim 1 and wherein the flexible cable is an optical fiber.

15. The method of mining as claimed in claim 1 and wherein the spall area is within a semi-hemispherical volume.

16. The method of mining as claimed in claim 1 and wherein the spall area has a radius of about three inches to about six feet.

17. The method of mining as claimed in claim 1 and wherein the drive unit is a transverse drive which moves the laser drill head longitudinally relative to the work surface, and the spall area so as to maintain a predetermined desirable distance between the rotating scan head and the spall area.

18. The method of mining as claimed in claim 1 and further comprising a face attachment which releasably communicates with the working surface and the laser drill head so as to positionally support the laser drill head relative to the working surface.

19. The method of mining as claimed in claim 1 and wherein the internal reflective optical elements comprise plural cooperating mirrors, and wherein each cooperating mirror is individually movable using an azimuth drive, and wherein the cooperating mirrors include a first folding mirror; a second oscillating mirror; and a third diverting mirror, and wherein the third diverting mirror transmits the laser beam through the transparent window and along an elevation of about plus 22.5 degrees and minus, 22.5 degrees while the rotating scanning head simultaneously rotates and wherein the rotation of the scanning head generates a semi-hemispherical shaped spall area.

20. The method of mining as claimed in claim 1 and wherein the internal reflective optical elements within the scan head are cooled by the stream of compressed air.

21. The method of mining as claimed in claim 1 and wherein a portion of the compressed air delivered to the rotating scan head is emitted through a cooling orifice which is proximate to the protective transparent window, and wherein the emitted compressed air forms a protective air curtain over and about the transparent window.

22. The method of mining as claimed in claim 1 and wherein plural laser drill heads are carried in a predetermined spaced relationship on a mining array so as to cause spilling over a larger area of working surface.

23. The method of mining as claimed in claim 22 and further comprising an X-Ray fluorescence (XRF) emitter/receiver and which is carried on the mining array, and which scans the strata for the desired mineral, and further receives fluorescence emitted by the strata, and the desired mineral, and wherein the X-Ray fluorescence (XRF) emitter/receiver communicates with the controller so as to allow an operator to direct the mining array to the desired mineral.

24. The method of mining as claimed in claim 22 and further comprising an illumination device and a video camera on the mining array, and wherein the method further comprises illuminating the work surface with the illumination device, and then video recording the spoiling so as to provide a video recording of the spalling to the controller; visually monitoring the spalling; and adjusting as necessary, the operation of the mining array.

* * * * *